US010197955B2

(12) United States Patent
Mochizuki

(10) Patent No.: US 10,197,955 B2
(45) Date of Patent: Feb. 5, 2019

(54) TEMPERATURE DETECTING MEMBER AND FIXING DEVICE

(71) Applicant: CANON KABUSHIKI KAISHA, Tokyo (JP)

(72) Inventor: Keisuke Mochizuki, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/492,702

(22) Filed: Apr. 20, 2017

(65) Prior Publication Data

US 2017/0308009 A1 Oct. 26, 2017

(30) Foreign Application Priority Data

Apr. 25, 2016 (JP) ..... 2016-086815

(51) Int. Cl.
*G03G 15/20* (2006.01)

(52) U.S. Cl.
CPC ..... *G03G 15/2039* (2013.01)

(58) Field of Classification Search
CPC ..... G03G 15/2039; G03G 2215/2035; G03G 15/2057; G03G 15/20; G03G 15/206; G03G 15/50; G03G 15/5004; G03G 15/6573; G03G 15/6585; G03G 15/80; G03G 2215/00801
See application file for complete search history.

(56) References Cited

U.S. PATENT DOCUMENTS

| | | | | |
|---|---|---|---|---|
| 4,424,507 | A * | 1/1984 | Nagai | H01C 7/041 338/22 R |
| 5,915,146 | A * | 6/1999 | Kusaka | G03G 15/2003 219/216 |
| 7,901,133 | B2 | 3/2011 | Otsuka | |
| 8,606,136 | B2 * | 12/2013 | Shimura | G01R 19/165 399/67 |
| 8,859,940 | B2 * | 10/2014 | Shimura | G03G 15/2078 219/216 |
| 2012/0308280 | A1 * | 12/2012 | Tsuruya | G03G 15/2042 399/329 |

FOREIGN PATENT DOCUMENTS

| | | | |
|---|---|---|---|
| JP | S6224288 | A | 2/1987 |
| JP | H10239170 | A | 9/1998 |
| JP | 2002156292 | A | 5/2002 |
| JP | 2002267543 | A | 9/2002 |
| JP | 2004053398 | A | 2/2004 |
| JP | 2008058370 | A | 3/2008 |
| JP | 2011040330 | A | 2/2011 |

* cited by examiner

*Primary Examiner* — Roy Y Yi
(74) *Attorney, Agent, or Firm* — Rossi, Kimms & McDowell LLP

(57) ABSTRACT

A temperature detecting member for detecting a temperature of an object of a fixing device in contact with the object includes a film having an insulating property, a temperature-sensitive element provided on the film, and an electroconductive pattern formed on the film. The electroconductive pattern is electrically connected with the temperature-sensitive element.

15 Claims, 24 Drawing Sheets

(a)

(b)

TEMPERATURE DETECTING MEMBER AND FIXING DEVICE

FIELD OF THE INVENTION AND RELATED ART

The present invention relates to a temperature detecting member and a fixing device (image heating apparatus) which are used with an image forming apparatus, such as a copying machine, a printer or a facsimile machine.

In the image forming apparatus (fixing device), such as the copying machine, the printer or the facsimile machine, of an electrophotographic type or an electrostatic recording type, the image heating apparatus for heating a toner image formed and carried on a recording material is provided. As regards the image heating apparatus, those of various types such as a heating roller type, a heating plate type, a heat chamber type and a film heating type, or having various constitutions have been known. Of these, the image heating apparatus (fixing device) of the film heating type is capable of reducing thermal capacity of the apparatus (device) compared with the apparatuses of the heating roller type and the like. For this reason, it becomes possible to realize electric power saving and reduction in wait time (quick start).

The image heating apparatus of the film heating type including a fixing film comprised of a heater as a heating member and a heat-resistant film fed while being press-contacted to the heating member and including a pressing roller as a pressing member for closely contacting a recording material as a material-to-be-heated to the heating member via the fixing film. Further, by supplying heat of the heating member to the recording material via the fixing film, the toner image on the recording material is heated.

As the heating member of the image heating apparatus of the film heating type, a constitution in which a heat generating resistor is formed on a ceramic substrate and the heat generating resistor is caused to generate heat by energization is used in general. Further, in this image heating apparatus, a temperature detecting member for detecting a temperature in the apparatus is provided. On the basis of temperature information detected by this temperature detecting member, energization to the heating member is controlled so that a temperature of the image heating apparatus is a predetermined temperature (proper toner image heating temperature).

As the temperature detecting member used for the image heating apparatus of the film heating type, an image heating apparatus of a type using a thermistor element has been known in general. For example, as disclosed in Japanese Laid-Open Patent Application (JP-A) 2002-267543, a type in which a thermistor is bonded onto a ceramic substrate as the heating member has been put into practical use. However, in recent years, with speed-up of the image forming apparatus, it is required to increase a control temperature of the heating member. Correspondingly, there has arisen a case where an adhesive for fixing the conventional thermistor cannot be used due to an insufficient heat-resistant temperature.

Therefore, for example, as disclosed in JP-A Hei 10-239170 and JP-A 2002-156292, a temperature detecting member of a type in which a thermistor element, a supporting portion for supporting the thermistor element, a mounting portion for mounting the thermistor element to the image heating apparatus, an external lead wire and the like are assembled into a unit and the unit is externally mounted to the heating member has been put into practical use. The temperature detecting member formed in the form of a unit as described above is used as a temperature detecting member of a type in which the temperature detecting member is contacted to the heating member as disclosed in JP-A 2002-267543 and as a temperature detecting member of a type in which the temperature detecting member is contacted to the fixing film as disclosed in JP-A 2004-53398.

In recent years, in the image heating apparatuses, there are needs of further improvements in electric power saving and quick start property. In order to meet these needs, further thermal capacity reduction has been required to be realized by downsizing the image heating apparatus of the film heating type, for example. In order to downsize the image heating apparatus, there is a need to downsize respective members used, and therefore downsizing of the temperature detecting member is not an exception.

However, in the case where the conventionally used temperature detecting member formed in the form of a unit is employed, there was a limit to reduction in volumes of the thermistor element supporting portion and the external lead wire while ensuring a retention capacity and an electric insulation property of the thermistor. Accordingly, there is a limit to downsizing of the image heating apparatus and the temperature detecting member constituted an obstacle to the downsizing of the image heating apparatus as a whole.

SUMMARY OF THE INVENTION

According to an aspect of the present invention, there is provided a temperature detecting member for detecting a temperature of an object of a fixing device in contact with the object, the temperature detecting member comprising: a film having an insulating property; a temperature-sensitive element provided on the film; and an electroconductive pattern formed on the film, the electroconductive pattern being electrically connected with the temperature-sensitive element.

According to another aspect of the present invention, there is provided a fixing device for fixing an image on a recording material, comprising: a cylindrical belt contacting the image; a heating member configured to heat the belt, the heating member contacting the belt; and a temperature detecting member configured to detect a temperature of the heating member, the temperature detecting member including a film having an insulating property, a temperature-sensitive element provided on the film, and an electroconductive pattern formed on the film and being electrically connected with the temperature-sensitive element, wherein the temperature detecting member is constituted so that at least a portion of the film corresponding to the temperature-sensitive element contacts the heating member.

Further features of the present invention will become apparent from the following description of exemplary embodiments with reference to the attached drawings.

DESCRIPTION OF EMBODIMENTS

Embodiments a temperature detecting member, an image heating apparatus and an image forming apparatus according to the present invention will be specifically described with reference to the drawings. Dimensions, materials, shapes and relative arrangements of constituent elements described in the following embodiments should be appropriately be changed depending on structures and various conditions of devices (apparatuses) to which the present invention is applied. That is, the scope of the present invention is not intended to be limited to the following embodiments.

[Embodiment 1]

First, structures of a temperature detecting member, an image heating apparatus and an image forming apparatus according to the present invention will be described using FIGS. 1 to 7.

<Image Forming Apparatus>

Figure 1:
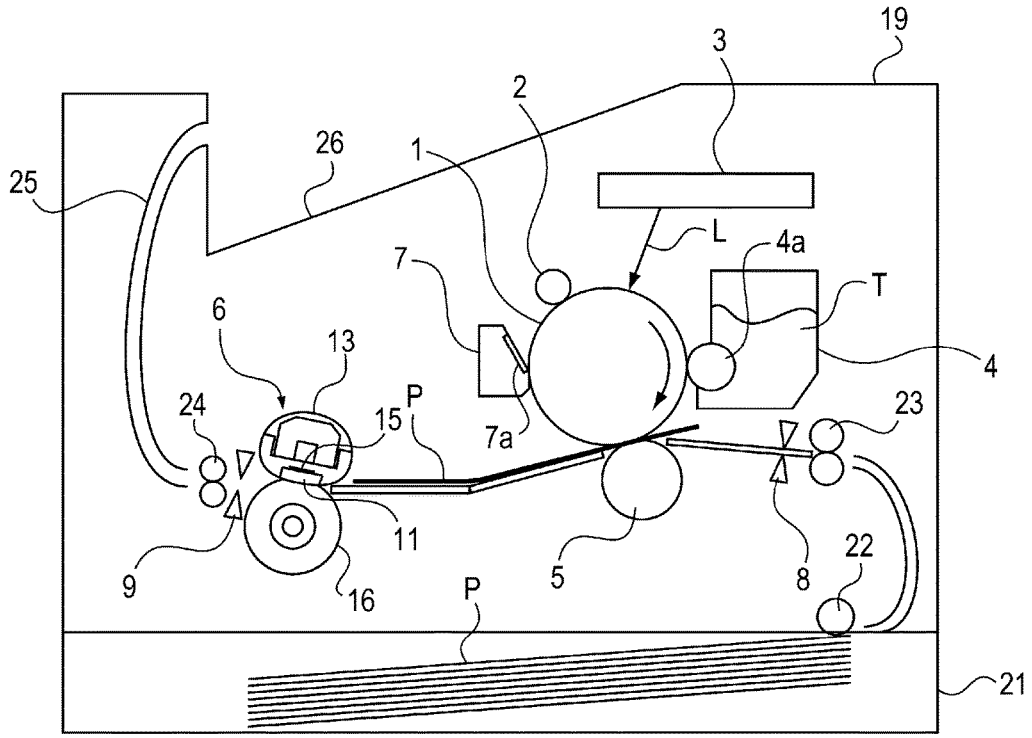
FIG. 1 is a sectional illustration showing a structure of an image forming apparatus according to the present invention.

The structure of the image forming apparatus according to this embodiment will be described using FIG. 1. FIG. 1 is a sectional illustration showing the structure of an image forming apparatus 19 according to the present invention. The image forming apparatus 19 shown in FIG. 1 is an example in which a laser beam printer (LBP) is used as the image forming apparatus 19 employing an image forming process of an electrophotographic type. In addition, the image forming apparatus 19 is also applicable to an image forming apparatus employing an image forming process of an electrostatic recording type. A temperature detecting member 15 used in the image forming apparatus 19 is an example constituted using a thermistor. A fixing device 6 consisting of an image heating apparatus used as a fixing means in the image forming apparatus 19 is provided with the temperature detecting member 15.

In FIG. 1, a photosensitive drum 1 as an image bearing member is prepared by forming a photosensitive material, such as OPC (organic photo-conductor; organic photo-semiconductor), amorphous selenium (a-Se) or amorphous silicon (a-Si) on a cylindrical substrate of aluminum, nickel or the like. A surface of the photosensitive drum 1 rotationally driven in an arrow direction of FIG. 1 is electrically charged uniformly by a charging roller 2 as a charging means.

Then, laser light L ON/OFF-controlled depending on image information is emitted from a laser scanner 3 as an image exposure means, so that the uniformly charged surface of the photosensitive drum 1 is subjected to scanning exposure by being irradiated with the laser light L. As a result, an electrostatic latent image depending on the image information is formed on the surface of the photosensitive drum 1.

The electrostatic latent image formed on the surface of the photosensitive drum 1 is developed by being supplied with a developer (toner T) from a developing sleeve 4*a* as a developer carrying member provided in a developing device 4 as a developing means, and thus is visualized. As a developing method, a jamming developing method in which electrically insulating toner is deposited on the surface of the photosensitive drum 1 by the jumping action of the developer by an AC bias. As another method, there is a two-component developing method using, as the developer, non-magnetic toner and a magnetic carrier.

As another method, an FEED (floating electrode effect developing) method or the like is used, and is used in combination of image exposure and reversal development. Incidentally, the FEED method is a developing method in which a toner layer is formed on a developer carrying member, including minute electrodes (floating electrodes) provided separately in an island shape, by a contact developing method using one-component insulative toner and then the electrostatic latent image is slid on the toner layer and is thus is developed.

On the other hand, a recording material P accommodated in a feeding cassette 21 is fed by a feeding roller 22 and is separated and fed one by one in cooperation with an unshown separating means. Thereafter, a leading end portion of the recording material P abuts against a nip of a registration roller pair 23 once stopped, so that oblique movement of the recording material P is corrected by stiffness of the recording material P.

The recording material P is fed at predetermined timing by the registration roller pair 23. Timing when the leading end portion of the recording material P fed by the registration roller pair 23 passes through a detecting position is detected by a top sensor 8. As a result, the recording material P is fed by the registration roller pair 23 so that an image position of the toner image formed on the surface of the photosensitive drum 1 and a writing position of the leading end of the recording material coincide with each other. The toner image visualized on the surface of the photosensitive drum 1 is transferred onto the recording material P by a transfer roller 5 as a transfer means. The recording material P is nipped and fed with a certain pressing force by the surface of the photosensitive drum 1 and the transfer roller 5.

The recording material P on which the toner image is transferred from the surface of the photosensitive drum 1 is fed to a fixing device 6 as a fixing means consisting of the image heating apparatus. The toner image is thermally melted by being heated and pressed in a process of being nipped and fed by an outer peripheral surface of a fixing film 13 which is an endless belt and a pressing roller 16 which is a rotatable pressing member, which are provided in the fixing device 6, and thus is heat-fixed as a permanent image on the recording material P. Thereafter, the recording material P is nipped and fed by a discharging roller pair 24 and passes through a feeding path constituted by a discharging guide 25 and the like, and is discharged on a discharge tray 26.

On the other hand, residual toner remaining on the surface of the photosensitive drum 1 after the transfer is scraped off and removed by a cleaning blade 7*a* provided in a cleaning device 7. A discharge sensor 9 provided between the fixing device 6 and the discharging roller pair 24 is a sensor for detecting paper jam or the like when the recording material P causes the paper jam or the like between the top sensor 8 and the discharge sensor 9.

<Image Heating Apparatus>

Figure 2:
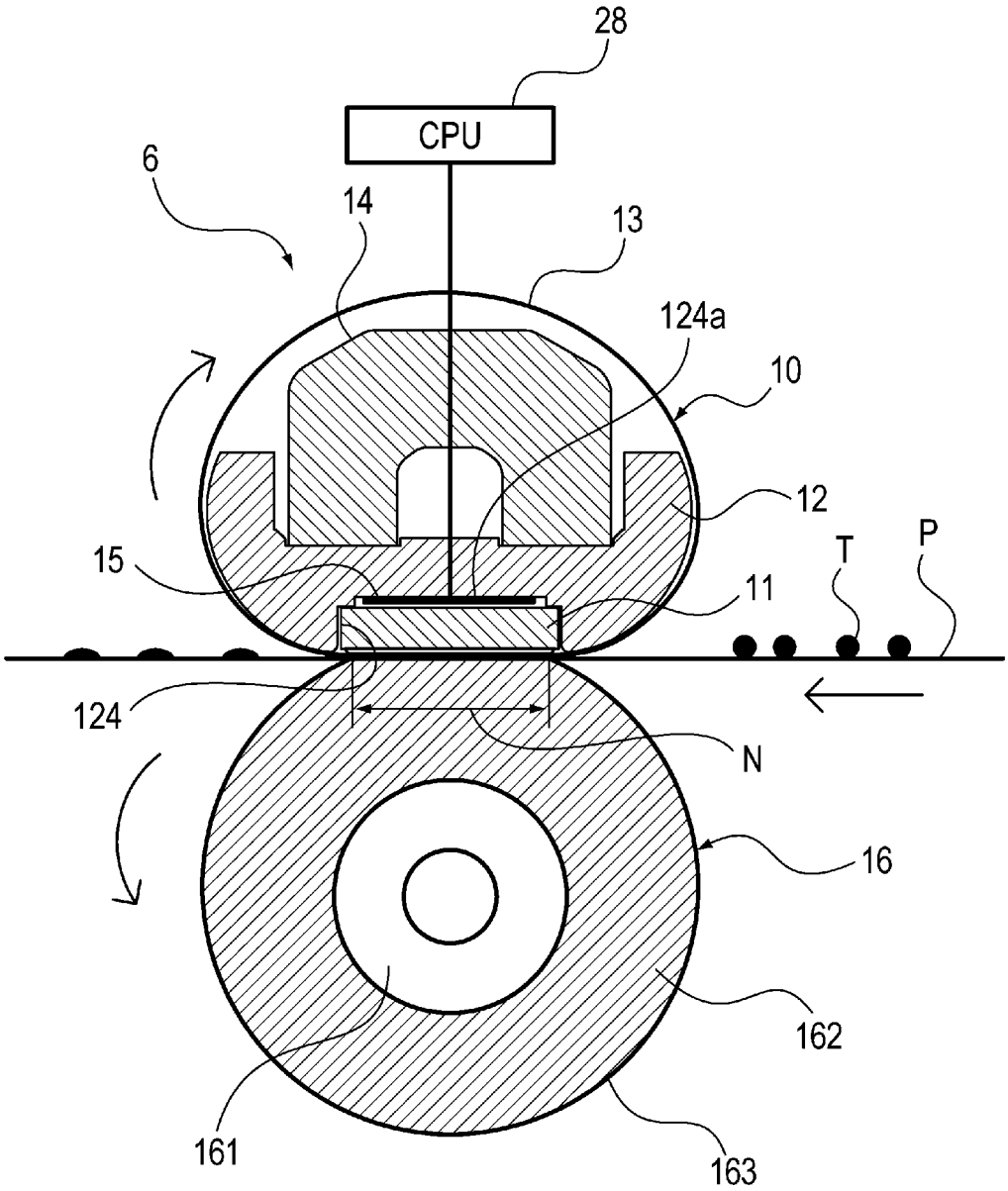
FIG. 2 is a sectional illustration showing a structure of an image heating apparatus in First Embodiment.

Next, a structure of the fixing device 6 which is the image heating apparatus in this embodiment will be described using FIG. 2. FIG. 2 is a sectional illustration showing the structure of the fixing device 6 as the image heating apparatus in this embodiment. The fixing device 6 shown in FIG. 2 is constituted by including a fixing assembly 10 and the pressing roller 16 for forming a fixing nip N by press-contact to each other.

The fixing assembly 10 includes the fixing film 13 (endless belt) and a heater 11 which is a heating member for heating the fixing film 13 in slide-contact with an inner peripheral surface of the fixing film 13. Further, the fixing assembly 10 is constituted by including a heat insulating holder 12 which is a supporting member for supporting the heater 11 and a metal-made stay 14 or the like for pressing the heat insulating holder 12 toward the pressing roller 16 by receiving an urging force from an unshown urging means. In this embodiment, the supporting member for rotatably supporting the fixing film 13 (endless belt) is constituted by the heat insulating holder 12 and the stay 14.

The heater 11 which is a heating member in this embodiment also has a function as a member for forming the fixing nip N between the outer peripheral surface of the flexible fixing film 13 and the pressing roller 16. The heater 11 slides on and contacts the inner peripheral surface of the fixing film 13, whereby the fixing nip N is heated. The pressing roller 16 as the rotatable pressing member is disposed opposed to the heater 11 (heating member) via the fixing film 13 (endless belt) and forms the fixing nip N (nip portion) between itself and the other peripheral surface of the fixing film 13.

The heater 11 is constituted in a plate shape with low thermal capacity. The heater 11 is prepared by forming an energization heat generating resistor L on the surface of a ceramic substrate, having an electrically insulating property, of alumina, aluminum nitride or the like by screen printing or the like. The energization heat generating resistor L is provided along a longitudinal direction (direction from a front side to a rear side on the drawing sheet of FIG. 2) of the heater 11. The energization heat generating resistor L is constituted by silver-palladium (Ag/Pd), ruthenium oxide ($RuO_2$), tantalum nitride ($Ta_2N$), or the like. As a surface layer of the heater 11 contacting the inner peripheral surface of the fixing film 13, a protective layer such as a glass layer for protecting the energization heat generating resistor L may also be provided within a range of not impairing heat efficiency.

The heat insulating holder 12 for supporting the heater 11 is formed of a heat-resistant resin material. As the heat-resistant resin material, it is possible to use a liquid crystal polymer, phenolic resin, polyphenylene sulfide (PPS). Further, another heat-resistant resin material such as polyether ether ketone (PEEK) can be used. The heat insulating holder 12 also has a function of guiding rotation of the fixing film 13 in a clockwise direction in FIG. 2.

The fixing film 13 consisting of a flexible endless belt is a heat-resistant film having a thickness of 200 μm or less in total in order to enable quick start. The fixing film 13 is formed using a heat-resistant resin material as a base layer.

As the heat-resistant resin material, it is possible to use polyimide (PI) and polyamideimide (PAI). Further, as base layer, another heat-resistant resin material such as polyether ether ketone (PEEK) can be used. Or, as the base layer, it is possible to use pure metal, having a heat-resistant property and a high heat-conductive property, such as stainless steel (SUS), aluminum (Al), nickel (Ni), copper (Cu), Zinc (Zn) or the like, or alloys of these metals.

Further, as the fixing film 13 which has sufficient strength for contacting a long-lifetime fixing device 6 (image heating apparatus) and which is excellent in durability, there is a need to have a thickness of 20 μm in total. Therefore, as the total thickness of the fixing film 13, 20 μm or more and 200 μm or less are optimum.

Further, in order to ensure offset prevention and a separating property of the recording material P, as a surface layer of the fixing film 13, a parting layer is formed. As the parting layer, it is possible to use a fluorine-containing resin material such as tetrafluoroethylene-perfluoroalkylvinyl ether copolymer (PFA). Further, another fluorine-containing resin material such as polytetrafluoroethylene (PTFE) can be used.

Further, as the parting layer, it is also possible to use fluorine-containing resin materials such as tetrafluoroethylene-hexafluoropropylene copolymer (FEP), ethylene-tetrafluoroethylene copolymer (ETFE), polychlorotrifluoroethylene (PCTFE) and polyvinylidene difluoride (PVdF). The heat-resistant resin materials, having a good parting property, such as these fluorine-containing resin materials or silicone resin materials can be coated in mixture or singly, so that the parting layer can be formed.

The pressing roller 16 is constituted by an elastic roller consisting of a core metal 161 formed of metal such as stainless steel (SUS), free-cutting steel (SUM) or aluminum (Al) and an elastic layer 162 formed outside the core metal 161. The elastic layer 162 is comprised of an elastic solid rubber formed with a heat-resistant rubber such as a silicone rubber or a fluorine-containing rubber or comprised of an elastic sponge rubber formed by foaming the silicone rubber in order to more impart a heat insulating effect.

Or, as the elastic layer 162, an elastic foam rubber in which a hollow filler (microballoon or the like) is dispersed in a silicone rubber layer and an air portion is provided in a cured product and thus the heat insulating effect is enhanced may also be used. Further, outside the elastic layer 162, a parting layer 163 of tetrafluoroethylene-perfluoroalkylvinyl ether copolymer (PFA), polytetrafluoroethylene (PTFE) or the like may also be formed.

In this embodiment, as the elastic layer 162, an electrically insulative silicone rubber foamed by microballoons was used. The pressing roller 162 using, as the parting layer 163, a 50 μm-thick tetrafluoroethylene-perfluoroalkylvinyl ether copolymer (PFA) tube was used.

Further, the pressing roller 16 is rotated in a counterclockwise direction of FIG. 2 by transmission of a rotational driving force to an unshown driving gear provided at an end portion of the core metal 161 with respect to an axial direction of the core metal 161. The rotational driving force transmitted to the pressing roller 162 is transmitted from an unshown motor in accordance with an instruction from a CPU (central processing unit) 28 as a control means. By the rotation of the pressing roller 16 in the counterclockwise direction in FIG. 2, the fixing film 13 press-contacted to the pressing roller 16 is rotated in the clockwise direction in FIG. 2 by a frictional force with the pressing roller 16.

Between the inner peripheral surface of the fixing film 13 and the heater 11, a lubricant such as a fluorine-based or silicone-based heat-resistant grease is interposed. As a result, a friction resistance is suppressed to a low value, so that the fixing film 13 becomes smoothly rotatable. The heat insulating holder 12 is provided with a temperature detecting member 15 in the rear side of the ceramic substrate of the heater 11. Depending on a temperature detection signal of the temperature detecting member 15, the CPU 28 determines and controls a duty ratio, wave number or the like of a voltage applied to the energization heat generating resistor layer provided in the heater 11, so that a temperature in the fixing nip N can be kept at a desired set fixing toner.

<Temperature Detecting Member>

Figure 3:
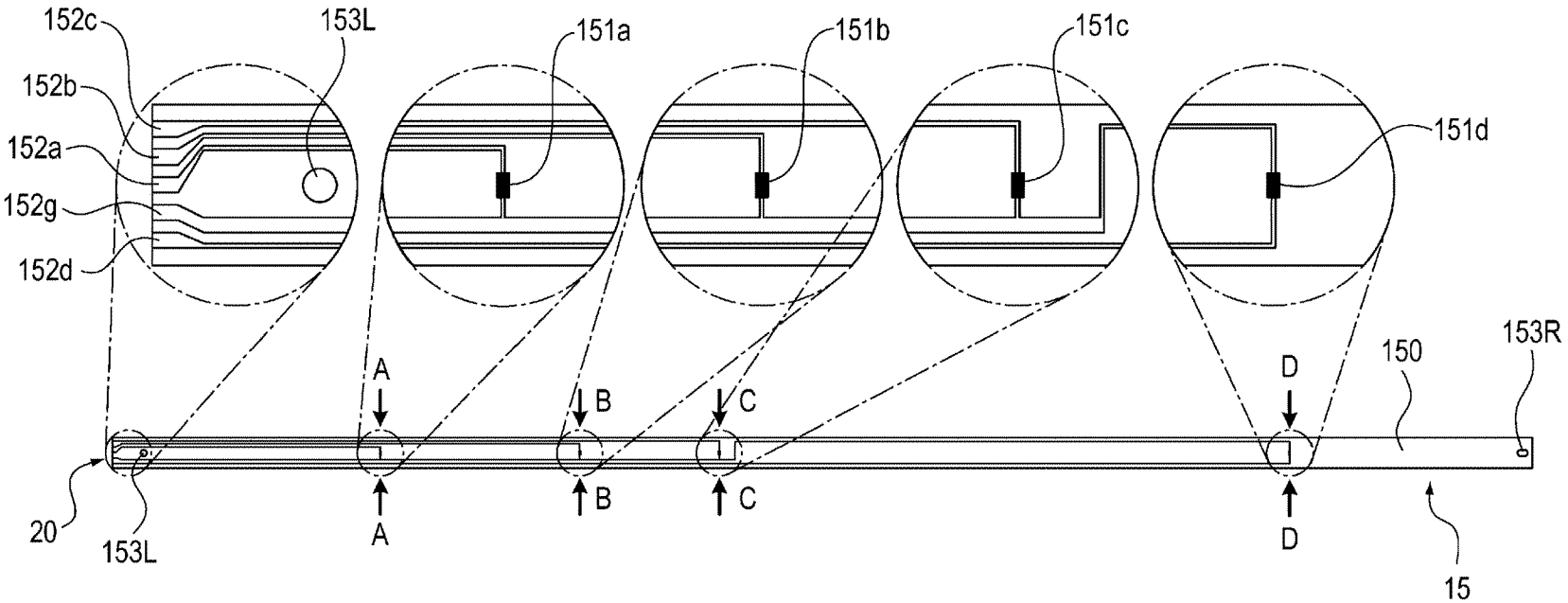
FIG. 3 is a bottom illustration (view) of a temperature detecting member in First Embodiment as seen from a pressing roller side.
Figure 4:
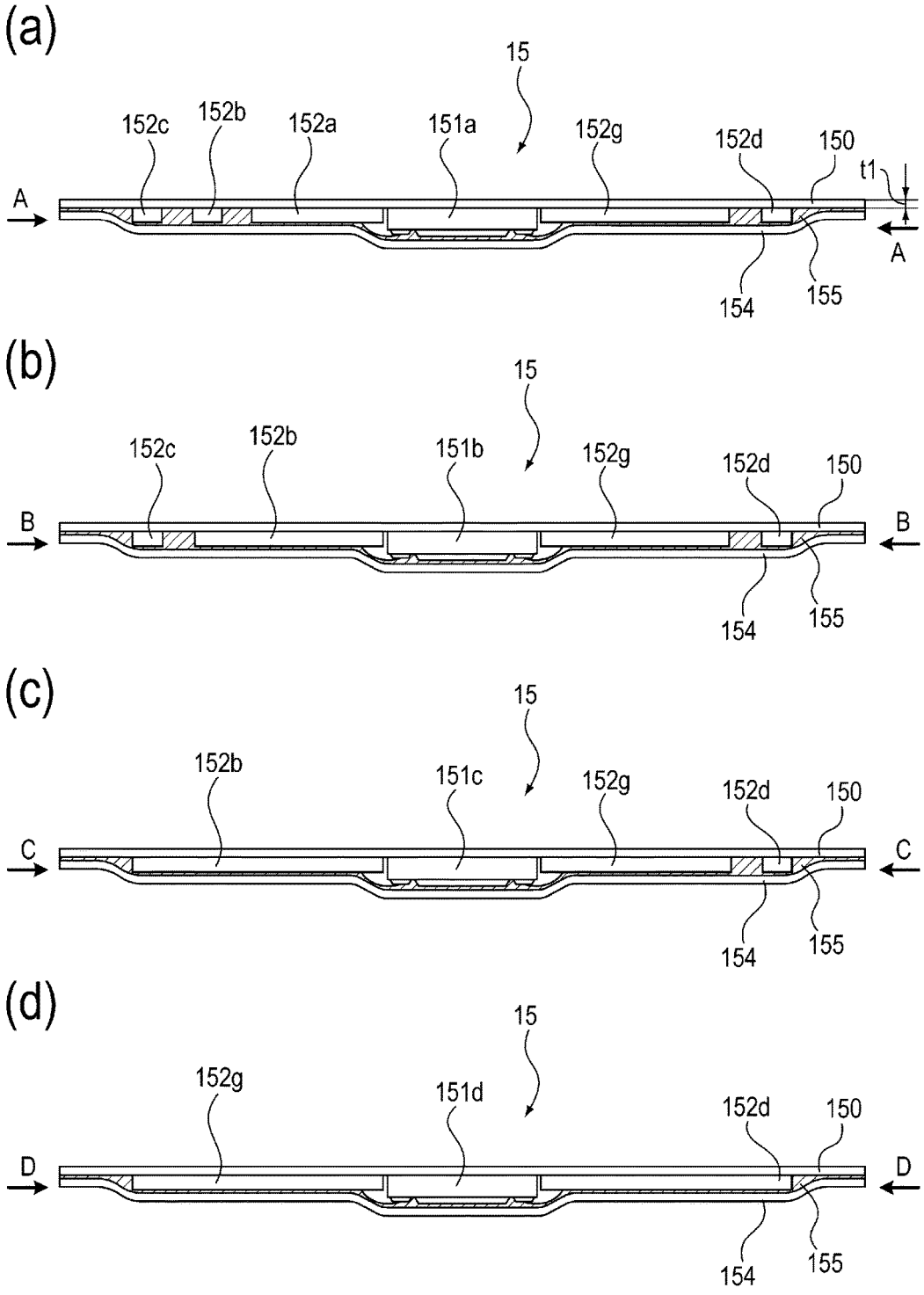
In FIG. 4, (a) is a sectional view of A-A in FIG. 3, (b) is a sectional view of B-B in FIG. 3, (c) is a sectional view of C-C in FIG. 3, and (d) is a sectional view of D-D in FIG. 3.

Next, using FIGS. 3 and 4, a constitution of the temperature detecting member 15 in this embodiment will be described. FIG. 3 is a belt illustration of the temperature detecting member 15 in this embodiment as seen from the pressing roller 16 side shown in FIG. 2. In FIG. 4, (a) is a sectional view of A-A in FIG. 3, (b) is a sectional view of B-B in FIG. 3, (c) is a sectional view of C-C in FIG. 3, and (d) is a sectional view of D-D in FIG. 3.

A vertical direction (up-down direction) in FIG. 3 is a feeding direction of the recording material P at the fixing nip N. In the following description, a direction parallel to the feeding direction of the roller P at the fixing nip N is referred to as a widthwise direction of the temperature detecting member 15 shown as the vertical direction in FIG. 3. Further, a left-right direction in FIG. 3 is referred to as a longitudinal direction of the temperature detecting member 15. Further, a direction (vertical direction in FIG. 4) perpendicular to the drawing sheet surface in FIG. 3 is referred to as a thickness direction of the temperature detecting member 15. This is also true for the heater 11 and the heat insulating holder 12 shown in FIG. 2.

As shown in FIG. 3, the temperature detecting member 15 includes a plurality of temperature-sensitive elements 151*a* to 151*d* provided at predetermined positions, respectively, with respect to the longitudinal direction thereof. Further, the temperature detecting member 15 includes a plurality of wiring electroconductors 152*a* and 152*d* connected with one end portion terminals of the temperature-sensitive elements 151*a* and 151*d*, respectively, and includes a wiring electroconductor 152*g* connected common to the other end portion terminals of the respective temperature-sensitive elements 151*a* and 151*d*.

Further, the temperature detecting member 152 includes, as shown in FIG. 4, a base layer 150 comprised of a film member, having a heat-resistant property and an electrically insulating property, for supporting the respective temperature-sensitive elements 151*a* to 151*d* and the respective wiring electroconductors 152*a* and 152*d* and 152*g*. Further, the temperature detecting member 150 includes an insulating layer 154 for covering the respective temperature-sensitive elements 151*a* to 151*d* and the respective wiring electroconductors 152*a* and 152*d* and 152*g*.

<Film Member>

The base layer 150 which is the film is an elongated member formed in a sheet shape formed of a resin material having a heat-resistant property and an electrically insulating property in a thickness of about 10-200 μm. As the base layer 150, it is possible to use polyimide (PI), polyamideimide (PAI), polyether ether ketone (PEEK), polyethylene terephthalate (PET), epoxy resin, or the like. As the base layer 150 in this embodiment, a polyimide film of 50 μm in thickness t1 is used.

<Wiring Electroconductor>

Each of the wiring electroconductors 152*a* to 152*d* and 152*g* is formed, of an electroconductive metallic material such as copper, as a circuit pattern (electroconductive pattern) on the base layer 150. The respective wiring electroconductors 152*a* to 152*d* and 152*g* are used for sending signals detected by the respective temperature-sensitive elements 151*a* to 151*d* to the CPU 28 provided outside the fixing assembly 10.

The circuit pattern of each of the wiring electroconductors 152*a* to 152*d* and 152*g* is formed, for example, by forming an electroconductive layer on the base layer 150 through bonding of a copper foil and then by subjecting this electroconductive layer to etching (process) through a photoresist method or the like. In place of the bonding of the copper foil, copper may also be subjected to electroplating, so that the electroconductive layer may also be formed. Further, the circuit pattern may also be directly formed on the base layer 15 by a screen printing method. In this embodiment, the five wiring electroconductors 152*a* to 152*d* and 152*g* which are electrically independent from each other are provided along the longitudinal direction of the temperature detecting member 15.

<Temperature-sensitive (Sensing) Element>

As each of the temperature-sensitive elements 151*a* to 151*d* in this embodiment, a thin-film thermistor element of 150 μm in thickness of a substrate. The four temperature-sensitive elements 151*a* and 151*d* are provided on the base layer 150. The temperature-sensitive elements 151*a* and 151*d* are electrically connected with the wiring electroconductors 152*a* to 152*d* and 152*g* by using electroconductive paste, solder, welding or the like.

In this embodiment, using silver paste, the temperature-sensitive elements 151*a* to 151*d* and the wiring electroconductors 152*a* to 152*d* and 152*g* are electrically connected. In order to prevent breakage of the wiring electroconductors 152*a* to 152*d* and 152*g* due to deviation of positions of the temperature-sensitive elements 151*a* to 151*d* by mechanical shock or thermal expansion, it is desirable that the temperature-sensitive elements 151*a* to 151*d* are fixed on the base layer 150 by bonding, adhesion or the like.

The temperature-sensitive element 151*a* is provided at an A-A cross-sectional position of FIG. 3, and with terminals thereof, the wiring electroconductors 152*a* and 152*g* are connected, respectively. The temperature-sensitive element 152*b* is provided at a B-B cross-sectional position of FIG. 3, and with terminals thereof, the wiring electroconductors 152*b* and 152*g* are connected, respectively.

The temperature-sensitive element 151*c* is provided at a C-C cross-sectional position of FIG. 3, and with terminals thereof, the wiring electroconductors 152*c* and 152*g* are connected, respectively. The temperature-sensitive element 152*d* is provided at a D-D cross-sectional position of FIG. 3, and with terminals thereof, the wiring electroconductors 152*d* and 152*g* are connected, respectively. The wiring electroconductor 152*g* is connected common to one terminals of the four temperature-sensitive elements 151*a* to 151*d*.

<Insulating Layer>

The insulating layer 154 is formed of a resin material which has a thickness of about 10-200 μm, a heat-resistant property and an electrically insulating property. As the insulating layer 154, it is possible to use polyimide (PI), polyamideimide (PAI), polyether ether ketone (PEEK), polyethylene terephthalate (PET), epoxy resin, or the like.

As the insulating layer 154 in this embodiment, a polyimide film of 50 μm in thickness t1 is used. The insulating layer 154 is applied onto the base layer 150 so as to cover the temperature-sensitive elements 151*a* to 151*d* and the wiring electroconductors 152*a* to 152*d* and 152*g* by using an adhesive 155 having an electrically insulating property and a heat-resistant property. The insulating layer 154 may also be applied onto the base layer 150 so as to cover the temperature-sensitive elements 151*a* to 151*d* and the wiring electroconductors 152*a* to 152*d* and 152*g* by using a double-coated tape or the like, having an electrically insulating property and a heat-resistant property, in place of the adhesive 155. Further, the insulating layer 154 may also be directly formed in a thin layer on the base layer 150, the temperature-sensitive elements 151*a* to 151*d* and the wiring electroconductors 152*a* to 152*d* and 152*g*.

The temperature detecting member 15 in this embodiment is constituted so that the temperature-sensitive elements 151*a* to 151*d* and the wiring electroconductors 152*a* to 152*d* and 152*g* are coated by the base layer 150 (film member) and the insulating layer 154. As a result, the temperature-sensitive elements 151*a* to 151*d* and the wiring electroconductors 152*a* to 152*d* and 152*g* are prevented from being damaged or abraded, so that the electrically insulating property is ensured.

<Placement of Temperature Detecting Member in Fixing Assembly>

Figure 5:
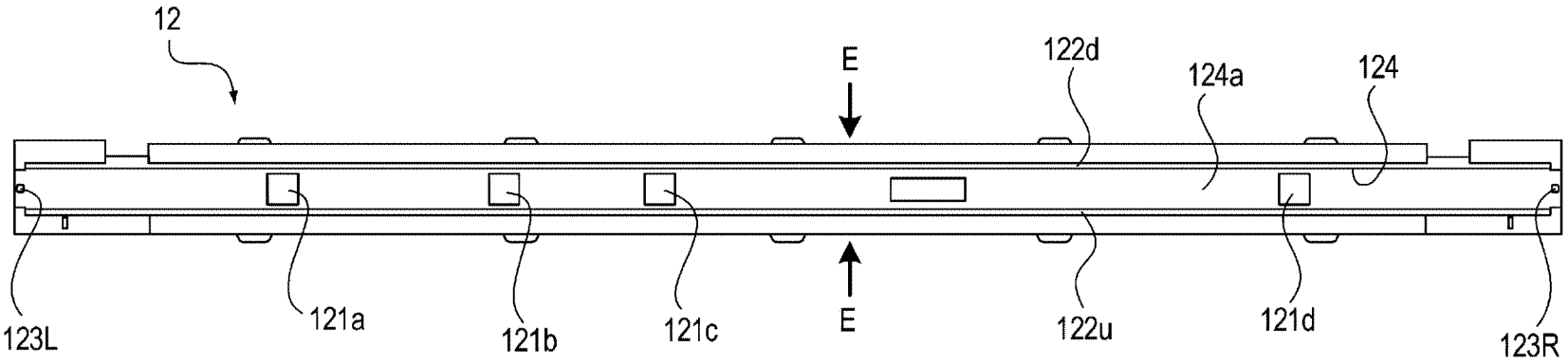
FIG. 5 is a plan illustration (view) showing a structure of a heat insulating holder in First Embodiment as seen from the pressing roller side.
Figure 16:
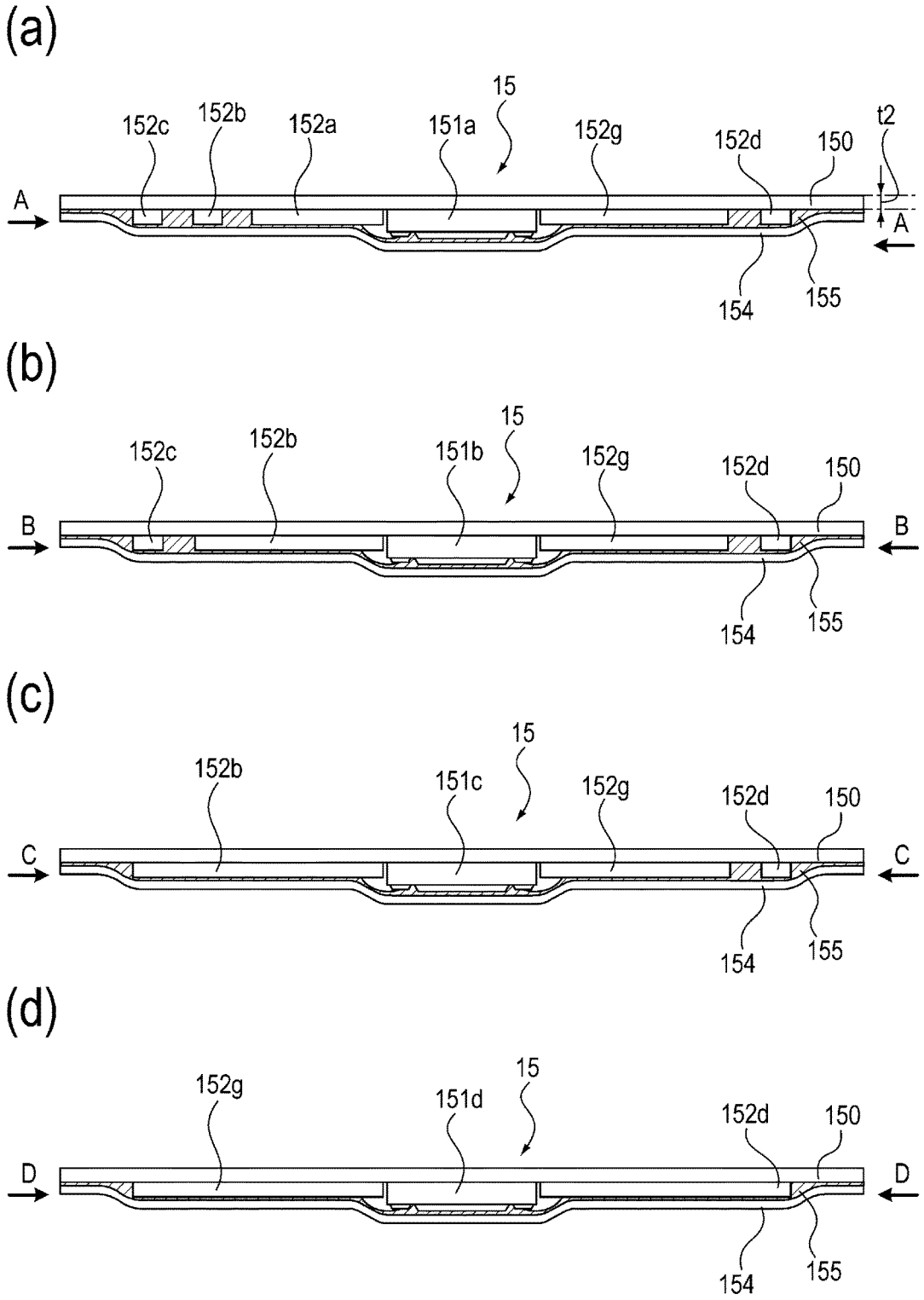
In FIG. 16, (a) is a sectional view of A-A in FIG. 15, (b) is a sectional view of B-B in FIG. 15, (c) is a sectional view of C-C in FIG. 15, and (d) is a sectional view of D-D in FIG. 15.

Next, using FIGS. 5 and 6, a method of placing the temperature detecting member 15 in the fixing assembly 10 will be described. FIG. 5 is a plan illustration showing a structure of the heat insulating holder 12 in this embodiment as seen from the pressing roller 16 side. In FIG. 16, (a) is a sectional illustration showing a structure of the fixing assembly 10 in this embodiment at a place connect the C-C position in FIG. 3, (b) is an exploded sectional view showing the structure of the fixing assembly 10 in this embodiment, and (c) is a sectional view, of E-E of FIG. 5, showing a structure of the heat insulating holder 12.

Figure 6:
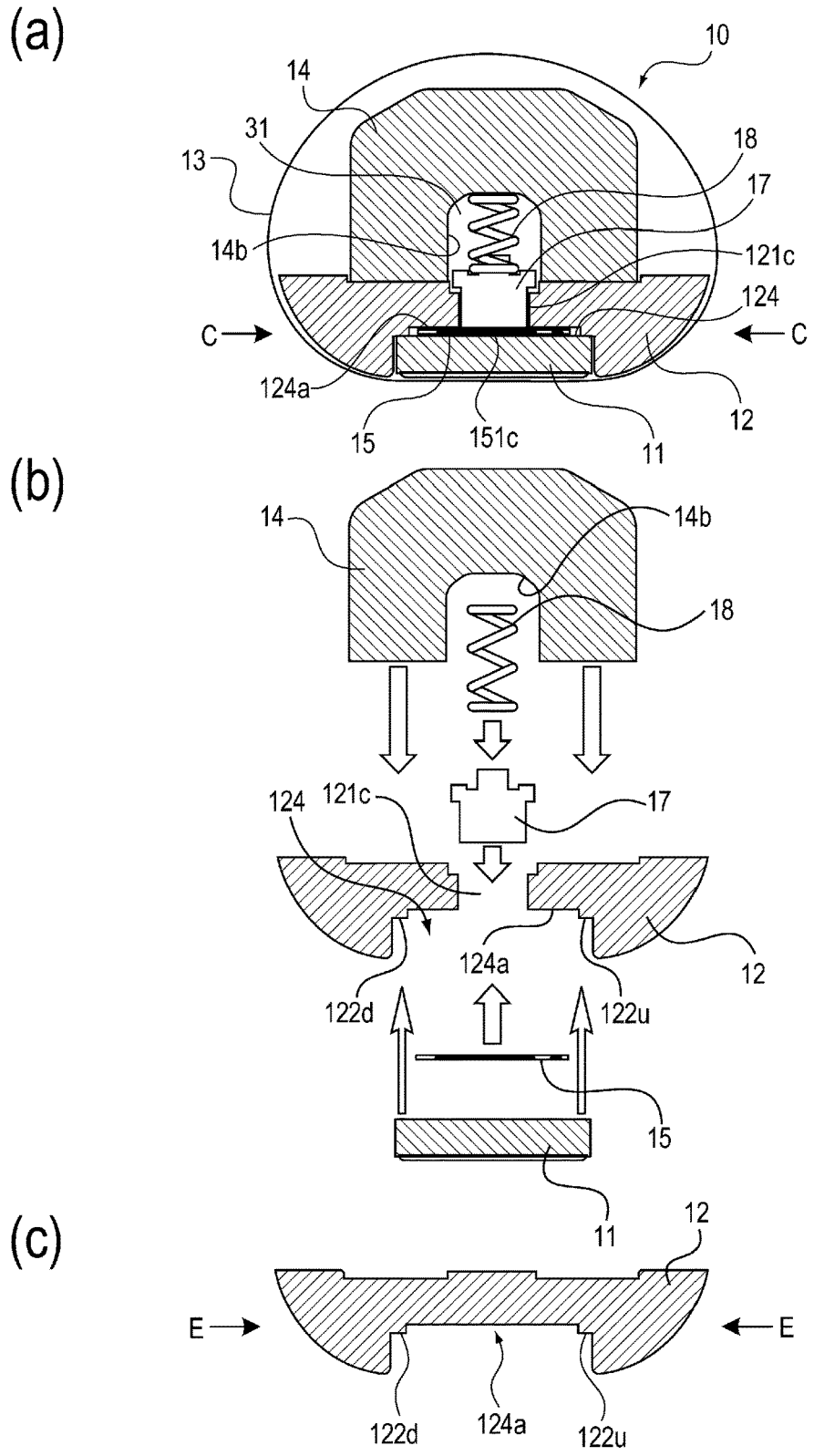
In FIG. 6, (a) is a sectional illustration showing a structure of a fixing assembly in First Embodiment at a place connect C-C position of FIG. 3, (b) is an exploded sectional view showing the structure of the fixing assembly in First Embodiment, and (c) is a sectional view, of E-E of FIG. 5, showing a structure of the heat insulating holder.

As shown in (a) of FIG. 6, the temperature detecting member 15 is disposed in a groove 124 provided on the heat insulating holder 12 shown in (c) of FIG. 6. The groove 124 is formed along a longitudinal direction (left-right direction in FIG. 5) of the heat insulating holder 12. A depth of the groove 124 with respect to the vertical direction in (c) of FIG. 6 is deeper (larger) than a thickness of the temperature detecting member 15 with respect to the vertical direction in (b) of FIG. 6, and a width of the groove 124 with respect to the left-right direction in (c) of FIG. 6 is broader than a width of the temperature detecting member 15 with respect to the left-right direction in (b) of FIG. 6.

As shown in FIG. 3, at end portions of the temperature detecting member 15 with respect to the longitudinal direction, through holes 153L and 153R are provided. Further, as shown in FIG. 5, at end portions of a sensor disposing surface 124*a* consisting of a bottom of the groove 124 of the heat insulating holder 12, projected portions 123L and 123R are provided in a projected state.

The temperature detecting member 15 is engaged in the groove 124 of the heat insulating holder 12, and the projected portions 123L and 123R of the heat insulating holder 12 are loosely fitted movably in the through holes 153L and 153R. As a result, the position of the temperature detecting member 15 with respect to the longitudinal direction is determined relative to the heat insulating holder 12. As regards the through holes 153L and 153R of the temperature detecting member 15, in view of a dimensional tolerance, one through hole 153L is formed as a circular (round) hole, and the other through hole 153R is formed as an elongated hole which is long with respect to the longitudinal direction of the temperature detecting member 15.

As shown in (b) of FIG. 6, after the temperature detecting member 15 is engaged in the groove 124 of the heat insulating holder 12, the heater 11 is further engaged into the groove 124, so that the heater 11 is contacted to and disposed on heater disposing surfaces 122*u* and 122*d* provided as a stepped portion at the groove 124. Longitudinal end portions of the heater 11 are fixed on the heat insulating holder 12 by an unshown heater clip.

The heater disposing surfaces 122*u* and 122*d* are formed at widthwise end portions of the groove 124 along the longitudinal direction (left-right direction in FIG. 5) of the heat insulating holder 12. The unshown heater clip has a function of fixing the position of the heater 11 relative to the heat insulating holder 12 by sandwiching the longitudinal end portions of the heater 11 in cooperation with the heat insulating holder 12. Incidentally, the function of the heater clip may also be performed by an energization connector, provided on the heater 11, for supplying electric power (energy) to the energization heat generating resistor L.

In this embodiment, as shown in (a) of FIG. 6, the temperature detecting member 15 and the heater 11 were provided by being engaged in the groove 124 of the heat insulating holder 12. As a result, the temperature detecting member 15 is loosely fitted and loosely supported in a gap of the groove 124 between the heater 11 and the heat insulating holder 12. A heat insulating layer of air is formed either one or both of between the temperature detecting member 15 and the heater 11 and between the temperature detecting member 15 and the sensor disposing surface 124*a* consisting of the bottom of the groove 124 of the heat insulating holder 12. For this reason, heat of the heater 11 is not readily conducted to the heat insulating holder 12, so that the recording material P can be efficiently heated from the heater 11 via the fixing film 13.

As shown in FIG. 5, at positions of the heat insulating holder 12 corresponding to the temperature-sensitive elements 151*a* to 151*d*, square through holes 121*a* to 121*d* in cross section are provided, respectively. The through hole 121*a* is provided at the position corresponding to the temperature-sensitive element 151*a*. The through hole 121*b* is provided at the position corresponding to the temperature-sensitive element 151*b*. The through hole (opening) 121*c* is provided at the position corresponding to the temperature-sensitive element 151*c*. The through hole 121*d* is provided at the position corresponding to the temperature-sensitive element 151*d*. In each of the through holes 121*a* to 121*d*, as shown in (a) of FIG. 6, a pressing member 17 by which one end portion of an elastic member 18 contacting an inner peripheral surface 14*b*, having a U-shape in cross section, of the stay 14 at the other end portion thereof is locked is movably engaged.

The elastic member 18 which is an urging member is an elastically compressed state between the pressing member 17 and the inner peripheral surface 14*b* of the stay 14. For this reason, portions of the temperature detecting member 15 corresponding to the temperature-sensitive elements are urged (pressed) in a direction toward the heater 11 (i.e., a direction from above toward below in (a) of FIG. 6) via the pressing member 17 by an elastic restoring force of the elastic member 18.

Thus, the portions of the temperature detecting member 15 connect the respective temperature-sensitive elements 151*a* to 151*d* are urged toward the heater 11 side via the pressing member 17 by an urging force of the elastic member 18 which is an urging means provided between the stay 14 as a supporting means and the heat insulating holder 12. As a result, the temperature detecting member 15 is contacted to the heater 11 (object) with reliability at the positions of the temperature-sensitive elements 151*a* to 151*d*.

The temperature-sensitive element 151 in this embodiment is comprised of a thermistor resistance element (chip), and the insulating layer 154 covering this temperature-sensitive element 151 contacts, as a temperature-sensitive element portion, the surface of the heater 11. As a result, temperature detection of the heater 11 can be stably carried out by the temperature-sensitive elements 151*a* to 151*d*. Further, heat-resistant grease is applied onto a surface of the temperature detecting member 15 contacting the heater 11. As a result, a contact heat resistance between the temperature detecting member 15 and the heater 11 is lowered. As a result, responsiveness of the temperature-sensitive elements 151*a* to 151*d* can be enhanced.

Further, it is desirable that a contact area between the pressing member 17 and the temperature detecting member 15 is reduced to a minimum by roughening a contact surface of the pressing member 17 with the temperature detecting member 15 through a creasing process for making a creased pattern (creases) on the surface. As a result, a contact heat (thermal) resistance of the pressing member 17 with the temperature detecting member 15 can be increased and unnecessary conduction of heat of the temperature-sensitive element 151*a*-151*d* portions can be prevented, so that it becomes possible to detect the temperature with accuracy.

Incidentally, in (a) and (b) of FIG. 6, an example in which the elastic member 18 (urging means) was constituted by a coil spring was shown, but for example, as the elastic member 18, a leaf spring, a low-hardness rubber member, a porous resin member and the like may also be used. As other example, the elastic member 18 may also be formed with elastic structure such as a felt structure in which fibers such as a nonwoven fabric are interwined in a firmly contracted state and a brush structure in which a large number of fibers, wires or the like are planted (set). Further, it is also possible to omit the elastic member 18 when elasticity is imparted to the pressing member 17 itself and thus the pressing member 17 also has a function of the elastic member 18.

<Contact Portion>

As shown in FIG. 3, the end portion of the temperature detecting member 15 in a side (left-hand side in FIG. 3) where the through hole 153L for positioning the temperature detecting member 15 is pulled out to a position, outside the fixing assembly 10, where the heat-resistant properly is not required relative to the inside of the fixing assembly 10. At this end portion, a contact portion 20 where one end portions of the respective wiring electroconductors 152*a*-152*d* and 152*g* are concentrated. With this contact portion 20, a terminal of an unshown energization connector is connected. As a result, it is possible to conduct outputs of the respective temperature-sensitive elements 151*a*-151*d* to an outside from the contact portion 20 provided at one end portions of the respective wiring electroconductors 152*a*-152*d* and 152*g*. Signals of the temperature-sensitive elements 151*a*-151*d* are sent to the CPU 28 as the control means, provided in the image forming apparatus 19, via the unshown energization connector connected with the contact portion 20.

<Modified Embodiment>

Figure 7:
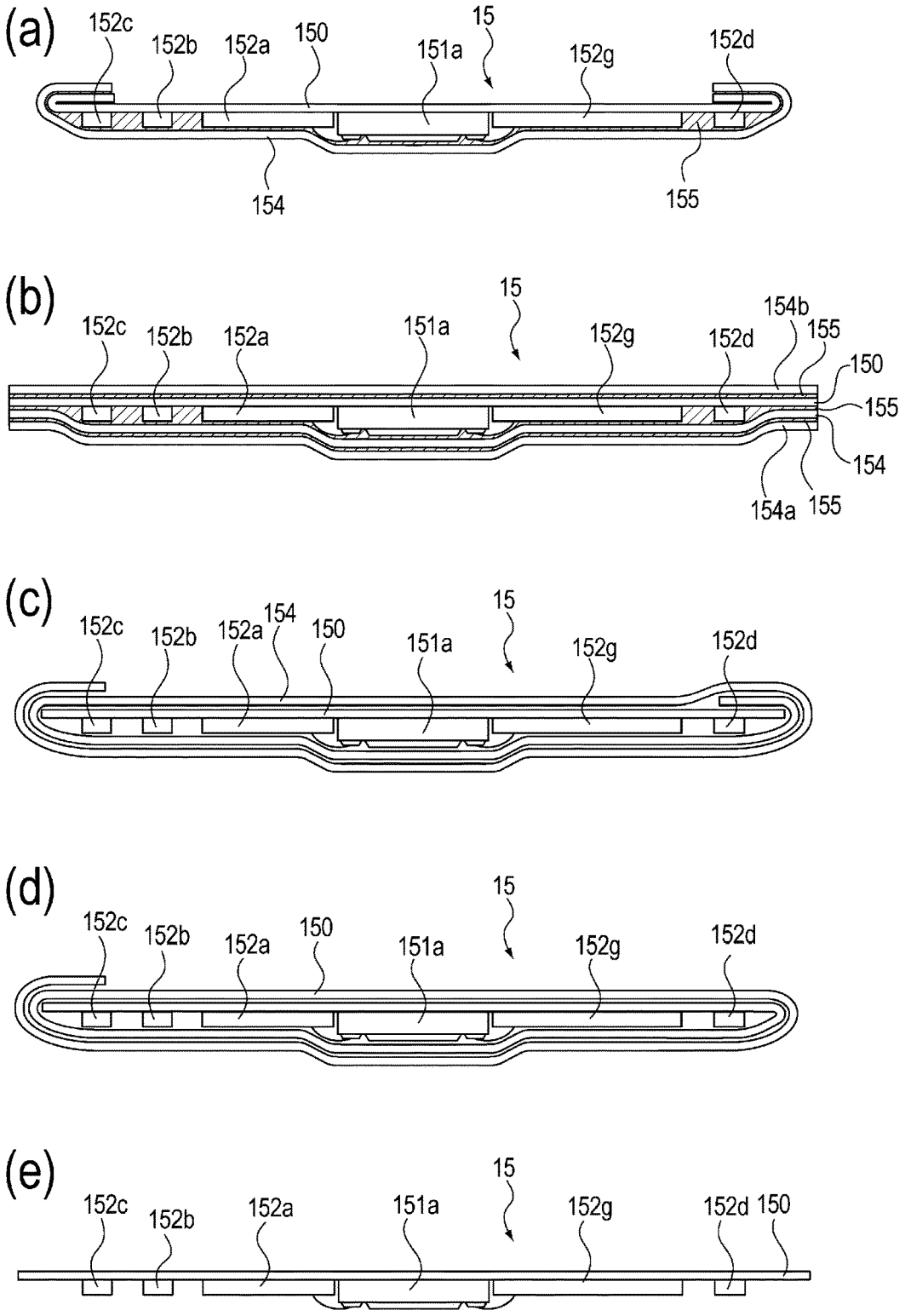
In FIG. 7, (a) to (e) are sectional illustrations showing temperature detecting members in modified embodiments of First Embodiment at A-A position of FIG. 3.

Next, modified embodiments of this embodiment will be described using FIG. 7. In FIG. 7, (a) to (e) are sectional illustrations showing the modified embodiments of the temperature detecting member 15 in this embodiment at A-A position in FIG. 3. Depending on a disposing place and a disposing method of the temperature detecting member 15 and a structural condition of the fixing device 6 to be placed, a higher electrically insulating performance is required in some cases.

For example, a creepage distance from an end portion of the temperature detecting member 15 with respect to a widthwise direction shown as the vertical direction in FIG. 3 to the wiring electroconductors 152*a*-152*d* and 152*g* is required to be made long in some instances. In that case, for example, as shown in (a) of FIG. 7, the base layer 150 and the insulating layer 154 shown in (a) of FIG. 4 are extended in the widthwise direction shown as the left-right direction in (a) of FIG. 7 and end portions thereof are folded back toward a central side. As a result, the creepage distance from the end portion of the temperature detecting member 15 with respect to the widthwise direction shown as the vertical direction in FIG. 3 to the wiring electroconductors 152*a*-152*d* and 152*g* can be made long without increasing a width of the temperature detecting member 15 with respect to the vertical direction in FIG. 3.

Further, for example, an electrically insulating performance between a member on which the temperature detecting member is mounted and the temperature-sensitive elements 151*a*-151*d* and the wiring electroconductors 152*a*-152*d* and 152*g* is required to be enhanced in some instances. In that case, as shown in (b) of FIG. 7, outside the base layer 150 and the insulating layer 154 shown in (a) of FIG. 4, insulating layers 154*a* and 154*b* are further added and are applied with an adhesive 155. As a result, the number of the insulating layers 154, 154*a* and 154*b* for covering the temperature-sensitive elements 151*a*-151*d* and the wiring electroconductors 152*a*-152*d* and 152*g* is increased, so that a higher electrically insulating performance can be obtained.

Further, instead of addition of the insulating layers 154*a* and 154*b* shown in (b) of FIG. 7, as shown in (c) of FIG. 7, an insulating layer 154 having a larger area is used. A periphery of the base layer 150, the temperature-sensitive elements 151*a*-151*d* and the wiring electroconductors 152*a*-152*d* and 152*g* is coated with the insulating layer 154 by winding the insulating layer 154 around these members, and also by this, a similar effect can be obtained. In this case, the adhesive 155 having the electrically insulating property and the heat-resistant property can be omitted.

Further, instead of addition of the insulating layer 154 shown in (c) of FIG. 7, as shown in (d) of FIG. 7, a base layer 150 having a larger area and an electrically insulating property is used. A periphery of the base layer 150 itself, the temperature-sensitive elements 151*a*-151*d* and the wiring electroconductors 152*a*-152*d* and 152*g* is coated with the base layer 150 by winding the base layer 150 around these members. Also by this, a similar effect can be obtained. In an example shown in (d) of FIG. 7, the base layer 150 which is a film member also functions as the insulating layer. That is, the film member and the insulating layer are constituted by the base layer 150 which is a single (the same) member. Also in this case, the adhesive 155 having the electrically insulating property and the heat-resistant property can be omitted.

Further, depending on the disposing place and the disposing method of the temperature detecting member 15 and the structural condition of the fixing device 6 to be placed, a distance from another electric circuit can be sufficiently ensured in some instances. In that case, the electrically insulating property between the temperature-sensitive elements 151*a*-151*d* and the wiring electroconductors 152*a*-152*d* and 152*g* on the base layer 150 may also be small. In that case, as shown in (e) of FIG. 7, the insulating layer 154 shown in (a) of FIG. 4 may also be omitted.

<Comparison Example>

Figure 8:
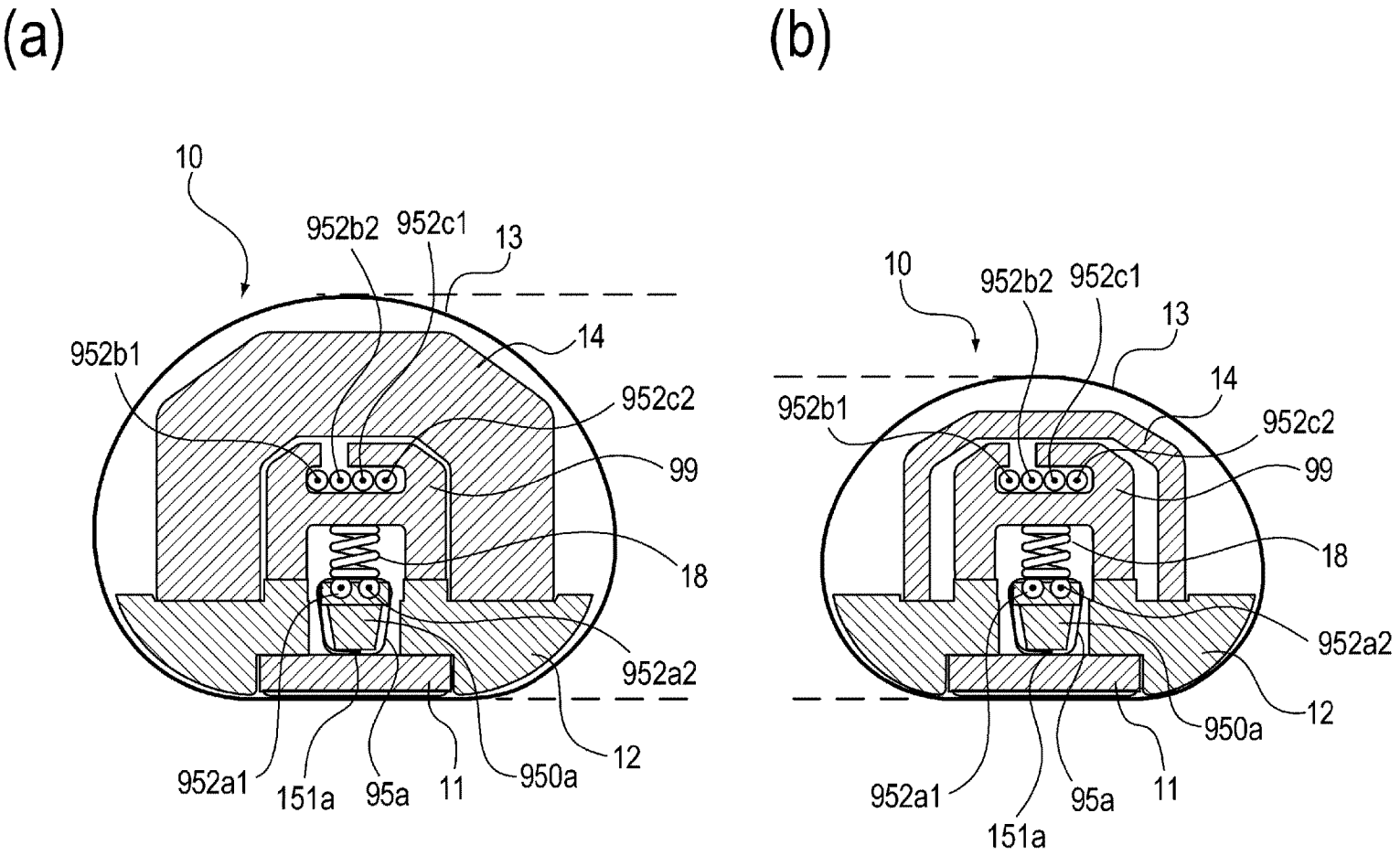
In FIG. 8, (a) is a sectional illustration showing a fixing assembly in a comparison example at A-A position of FIG. 3, and (b) is a sectional illustration showing a constitution, at the A-A position of FIG. 3, in which the fixing assembly is downsized by making a stay thin.
Figure 9:
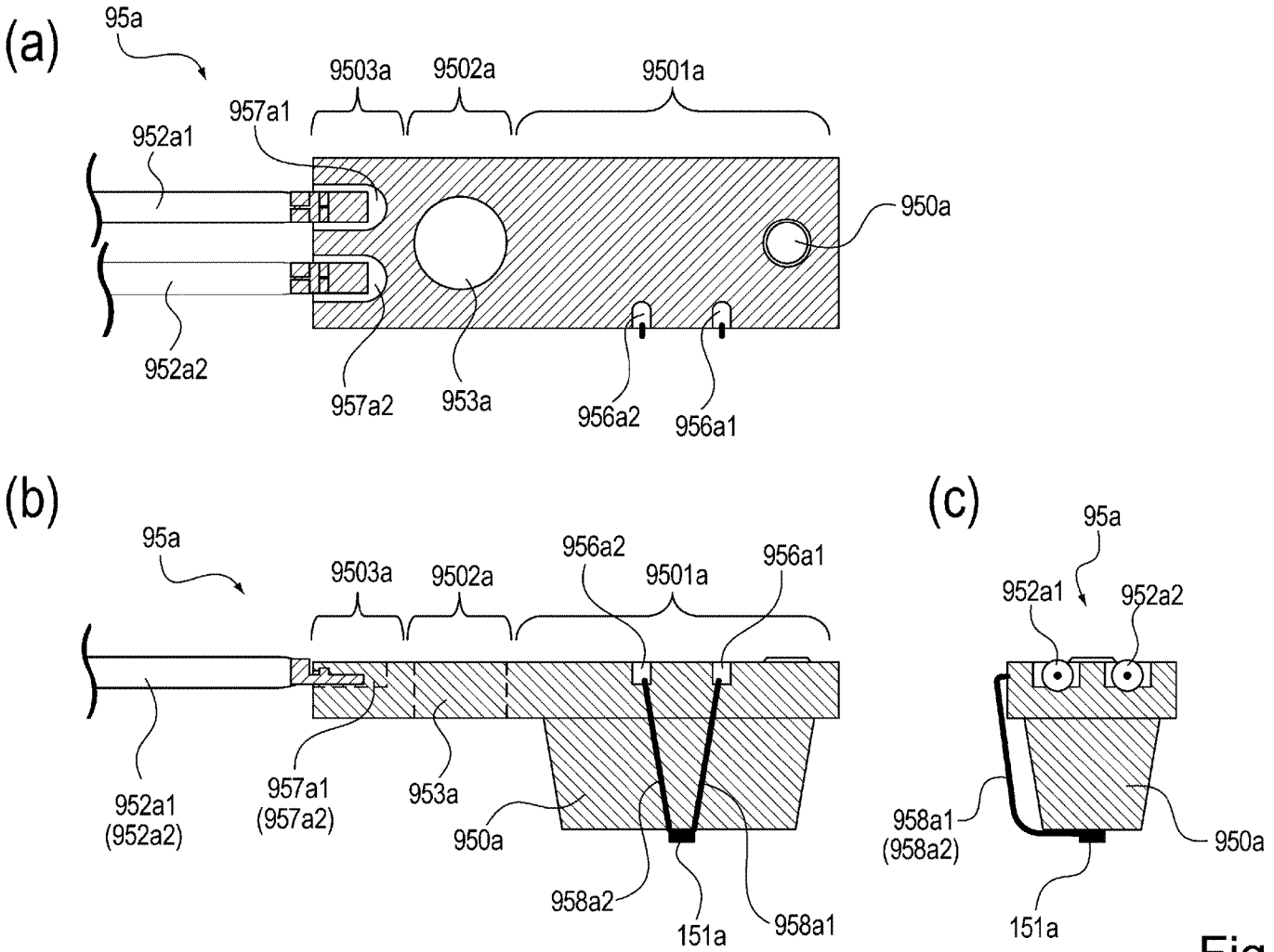
In FIG. 9, (a) is a plan illustration showing a structure of a temperature detecting member in the comparison example, and (b) and (c) are sectional illustrations showing the structure of the temperature detecting member in the comparison example.

Next, structures of temperature detecting members 95*a*-95*d* in a comparison example and a fixing assembly 10 in which these members are incorporated will be described using FIGS. 8 and 9. Incidentally, members or portions constituted similarly as those in the above-described First Embodiment will be omitted from description by adding the same reference numerals or symbols or the same member names even when the symbols are different. In FIG. 8, (a) is a sectional illustration showing the structure of the fixing assembly 10 in the comparison example at A-A position in FIG. 3. In FIG. 8, (b) is a sectional illustration showing a structure, in which a stay 14 shown in (a) of FIG. 8 is made thin and thus the fixing assembly 10 in the comparison example is downsized, at A-A position in FIG. 3. In FIG. 9, (a) is a plan illustration showing the structure of the temperature detecting member 95*a* in the comparison example, and (b) and (c) are sectional illustrations each showing the structure of the temperature detecting member 95*a* in the comparison example.

In this comparison example, the temperature detecting members 95*a*-95*d* for detecting the temperature of the heater 11 is used, and are provided at four positions corresponding to the four temperature-sensitive elements 151*a*-151*d* in First Embodiment shown in FIG. 3. Incidentally, basic structures of the respective temperature detecting members 95*a*-95*d* are the same, and therefore the structure of the temperature detecting member 95*a* will be described as a representative.

As shown in (a) to (c) of FIG. 9, the temperature detecting member 95*a* is constituted by a temperature-sensitive element 151*a*, a base 950*a* and two external lead wires 952*a*1 and 952*a*2. The base 950*a* is comprised of a supporting portion 9501*a* for supporting the temperature-sensitive element 151*a*, a connecting portion 9503*a* with which the external lead wires 952*a*1 and 952*a*2 are connected, and a positioning portion 9502*a* for determining a mounting position of the temperature detecting member 95*a*.

Inside the base 950*a*, unshown two internal electroconductors formed with thin metal plates are embedded. These internal electroconductors project at one end portions thereof from the supporting portion 9501*a* for supporting the temperature-sensitive element 151*a*, and form connector portions 956*a*1 and 956*a*2. The internal electroconductors project at the other end portions thereof from the connecting portion 9503*a* with which the external lead wires 952*a*1 and 952*a*2 are connected, and form connector portions 957*a*1 and 957*a*2.

At a lower portion of the supporting portion 9501*a* for supporting the temperature detecting member 151*a*, the temperature-sensitive element 151*a* is mounted, and with terminals of the temperature-sensitive element 151*a*, two internal lead wires 958*a*1 and 958*a*2 are connected, respectively. The internal lead wires 958*a*1 and 958*a*2 are welded to the connector portions 956*a*1 and 956*a*2, respectively, provided at an upper portion of the supporting portion 9501*a* for supporting the temperature detecting member 151*a*. An unshown heat-resistant insulative film is wound around the supporting portion 9501*a* for supporting the temperature-sensitive element 151*a*, so that a necessary electrically insulating property is ensured.

The external lead wires 952*a*1 and 952*a*2 are metal wires subjected to insulation coating and are used for sending a signal detected by the temperature-sensitive element 151*a* to an outside of the fixing assembly 10.

One end portions of the external lead wires 952*a*1 and 952*a*2 are welded to the connector portions 957*a*1 and 957*a*2 provided at the connecting portion 9503*a*.

The external lead wires 952*a*1 and 952*a*2 are led out to the outside of the fixing assembly 10 while being guided by a wiring guiding member 99 shown in (a) and (b) of FIG. 8 and are connected with unshown energization connectors. As a result, the signal detected by the temperature-sensitive element 151*a* is transmitted to the CPU 28 as the control means provided in the image forming apparatus 19.

Incidentally, in this comparison example, the external lead wires 952*a*1, 952*a*2-952*c*1 and 952*c*2 are guided from the rear side toward the front side on the drawing sheet of (a) and (b) of FIG. 8. Further, these external lead wires are led out to the outside of the fixing assembly 10 from a side end portion of the heat insulating holder 12 in the front side on the drawing shape of (a) and (b) of FIG. 8.

On the other hand, external lead wires 952*d*1 and 952*d*2 are guided from the front side toward the rear side on the drawing sheet of (a) and (b) of FIG. 8 for the purpose of saving a wiring space. Further, these external lead wires are led out to the outside of the fixing assembly 10 from a side end portion of the heat insulating holder 12 in the rear side on the drawing shape of (a) and (b) of FIG. 8.

As shown in (a) of FIG. 9, at the positioning portion 9502*a* for determining a mounting position of the temperature detecting member 95*a*, a positioning hole 953*a* consisting of a through hole is provided. In the positioning hole 953*a*, an unshown positioning projected portion provided on the heat insulating holder 12 in a projected state is loosely fitted. As a result, a position of the temperature detecting member 95*a* relative to the heat insulating holder 12 with respect to the longitudinal direction and the widthwise direction is determined.

Further, an upper portion of the base 950*a* is pressed in a direction of the heater 11 by the elastic member 18 shown in (a) and (b) of FIG. 8. As a result, the temperature detecting member 95*a* is urged toward the heater 11. In this comparison example, the portion of the temperature-sensitive element 151*a* (temperature-sensitive element portion) provided on the temperature detecting member 95*a* contacts the heater with reliability, so that stable temperature detection becomes possible. In this comparison example, such a complicated constitution that the external lead wires 952*a*1 and 952*a*2 are connected with the unshown internal electroconductors and thereafter are connected with the terminals of the temperature-sensitive element 151*a* via the interval lead wires 958*a*1 and 958*a*2 is employed.

On the other hand, in the above-described First Embodiment, as shown in FIGS. 3 and 4, the constitution in which both of the respective temperature-sensitive elements 151*a*-151*d* and the respective wiring electroconductors 152*a*-152*d* and 152*g* are directly connected with each other while supporting these members by using the thin film-shaped base layer 150 was employed. Accordingly, the internal electroconductors provided inside the base 950*a* and the portions for coating the internal electroconductors in an electrically insulating state as in the comparison example can be omitted. As a result, downsizing and thermal capacity reduction of the temperature detecting member 15 can be realized.

Further, in the above-described First Embodiment, the projected portions 123L and 123R projected from the sensor disposing surface 124*a* of the heat insulating holder 12 shown in FIG. 5 are engaged in the through holes 153L and 153R provided in the temperature detecting member 14 shown in FIG. 3. As a result, the temperature detecting member 15 is positioned relative to the heat insulating holder 12.

As a result, the positioning portion 9502*a* for determining the mounting position of the temperature detecting member 95*a* on the base 950*a* in the comparison example shown in (a) and (b) of FIG. 9 can be simplified. As a result, in the above-described first Embodiment, compared with the comparison example, downsizing and thermal capacity reduction of the temperature detecting member 15 can be realized.

The external lead wires 952*a*1, 952*a*2-952*d*1 and 952*d*2 in the comparison example shown in (a) and (b) of FIG. 8 and (a) to (c) of FIG. 9 were independently subjected to insulation coating one by one. On the other hand, in this embodiment, the plurality of wiring electroconductors 152*a*-152*d* and 152*g* can be subjected to insulation coating altogether by the base layer 150 and the insulating layer 154.

As a result, in this embodiment, a volume of the insulation coating member can be reduced compared with the comparison example, so that it is possible to realize the downsizing and the thermal capacity reduction of the temperature detecting member 15. Naturally, the number of wires of the wiring electroconductors 152*a*-152*d* and 152*g* increases with an increasing number of the temperature-sensitive elements 151*a*-151*d* to be placed. By the thermal capacity reduction of the temperature detecting member 15, thermal capacity reduction of the fixing device 6 as the image heating apparatus in which the temperature detecting member 15 is incorporated can also be realized.

In this embodiment, the plurality of wiring electroconductors 152*a*-152*d* and 152*g* corresponding to the external lead wires 952*a*1, 952*a*2-952*d*1 and 952*d*2 in the comparison example shown in (a) and (b) of FIG. 8 were formed altogether on the single base layer 150 as shown in FIG. 3. As a result, wiring routing becomes easy, so that the wiring guiding member 99 in the comparison example shown in (a) and (b) of FIG. 8 can be simplified. Correspondingly to the simplification of the wiring guiding member 99 in the comparison example shown in (a) and (b) of FIG. 8, the thermal capacity reduction of the fixing device 6 can be realized.

Further, in this embodiment, as shown in (a) of FIG. 6, the temperature detecting member 15 was accommodated in the groove 124 provided on the heat insulating holder 12. As a result, different from the comparison example shown in (a) and (b) of FIG. 8, there is no need to separately provide the wiring guiding member 99 and thus contributes to the thermal capacity reduction largely.

Further, in this embodiment, the fixing assembly 10 shown in FIG. 2 can be downsized. As a result, also downsizing of the fixing device 6 can be realized. For example, in order to downsize the fixing assembly 10 in the comparison example shown in (a) of FIG. 8, there was a need that the heater 11, the heat insulating holder 12, the wiring guiding member 99 and the stay 14 were thinned an downsized and that a space for decreasing a diameter of the fixing film 13 was provided.

However, when the heater 11, the heat insulating holder 12 and the wiring guiding member 99 are further thinned, necessary strength cannot be maintained, and therefore it is difficult to carry out the thinning of these members. As shown in (b) of FIG. 8, in the case where the fixing assembly 10 is downsized by thinning the stay 14, rigidity of the stay 14 lowers. As a result, when a pressing force is applied to the stay 14 for pressing the heat insulating holder 12 toward the pressing roller 16, the stay 14 is flexed with respect to the longitudinal direction, so that the toner image on the recording material P is not readily pressed uniformly.

On the other hand, in the case where the temperature detecting member 15 in this embodiment shown in (a) of FIG. 6 is used, downsizing can be realized compared with the comparison example shown in (a) and (b) of FIG. 8. In the comparison example shown in (a) and (b) of FIG. 8, the insulation coating members or the like, such as the wiring guiding member 99, the base 950*a* and the external lead wires 952*a*1, 952*a*2-952*d*1 and 952*d*2 exist in a space enclosed by the stay 14 and the heat insulating holder 12. When the temperature detecting member 15 in this embodiment is used, the insulation coating members or the like, such as the wiring guiding member 99, the base 950*a* and the external lead wires 952*a*1, 952*a*2-952*d*1 and 952*d*2 in the comparison example can be downsized or omitted.

Further, by using an excessive space generated by the downsizing or the omission, downsizing of the stay 14 becomes possible without decreasing the thickness. As a result, the fixing assembly 10 can be downsized, so that the downsizing of the fixing device 6 can be achieved.

<Second Embodiment>

Figure 10:
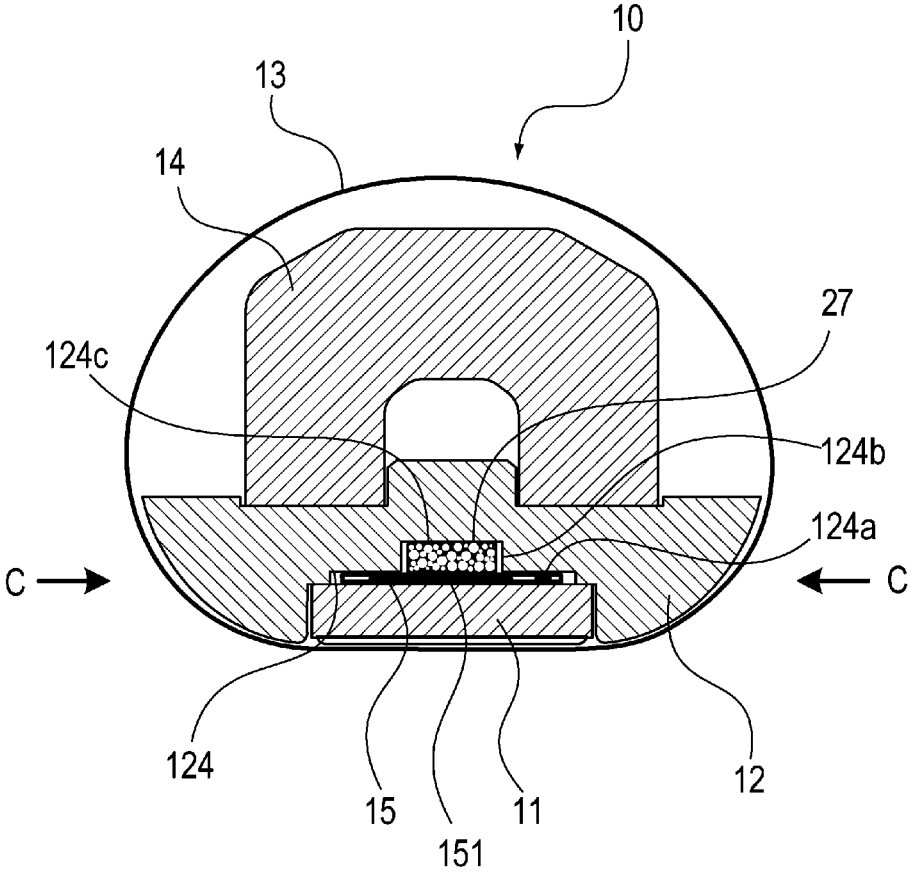
FIG. 10 is a sectional illustration showing a structure of a fixing assembly in Second Embodiment at a place connect C-C position of FIG. 3.

Next, structures of a temperature detecting member, in image heating apparatus and an image forming apparatus according to the present invention in Second Embodiment will be described using FIG. 10. Incidentally, members or portions constituted similarly as those in the above-described First Embodiment will be omitted from description by adding the same reference numerals or symbols or the same member names even when the symbols are different. FIG. 10 is a sectional illustration showing a structure of a fixing assembly in Second Embodiment at a place corresponding to C-C position in FIG. 3.

As shown in FIG. 10, in this embodiment, in place of the through hole 121*c* provided in the heat insulating holder 12 in First Embodiment shown in (a) of FIG. 6, a recessed portion 124*b* continuous to the groove 124 is provided. Inside the recessed portion 124*b*, a pressing member 27 which is an urging member for urging (pressing) the portion of the temperature-sensitive element 151*c*, provided on the temperature detecting member 15, toward the heater 11 is accommodated. The pressing member 27 is fixed at one end portion thereof on a bottom 124*c* of the recessed portion 124*b* with an adhesive or a double-coated tape or the like. The pressing member 27 presses, at the other end portion thereof, the portion of the temperature-sensitive element 151*c* provided on the temperature detecting member 15 in a direction toward the heater 11.

<Urging Member>

The pressing member 27 as the urging means is a member having the function of the urging means constituted by the pressing member 17 and the elastic member 18 in the above-described First Embodiment. The pressing member 27 is formed with, e.g., a low-hardness rubber, a porous resin material or the like. The pressing member 27 is in an elastically compressed state between the temperature detecting member 15 and the bottom 1214*c* of the recessed portion 124*b* of the heat insulating holder 12. For this reason, the portions of the temperature-sensitive elements 151*a*-151*d* of the temperature detecting member 15 are urged in the direction of the heater 11 by an elastic restoring force of the pressing member 27.

Thus, the portions of the temperature-sensitive elements 151*a*-151*d* of the temperature detecting member 15 are urged in the direction of the heater 11 by the pressing member 27 as the urging means provided in the recessed portion 124*b* of the heat insulating holder 12 as the supporting member. As a result, the temperature detecting member 15 contacts the heater 11 (object) with reliability at the portions of the temperature-sensitive elements 151*a*-151*d*. As a result, temperature detection of the heater 11 can be stably carried out by the temperature-sensitive elements 151*a*-151*d* of the temperature detecting member 15.

In this embodiment, as in First Embodiment shown in (b) of FIG. 6, at portions corresponding to the temperature-sensitive elements 151*a*-151*d*, the through holes 121*a*-121*d* may also be not provided in the heat insulating holder 12. As a result, rigidity of the heat insulating holder 12 can be further uniformized. For that reason, compared with the above-described First Embodiment, a further uniform permanent image is readily obtained.

Also in this embodiment, the realization of the downsizing and the thermal capacity reduction of the fixing device 10 in comparison with the above-described comparison example with reference to FIGS. 8 and 9 is similar to that in the above-described First Embodiment. Other constitutions are similar to those in the above-described First Embodiment, so that a similar effect can be obtained.

<Third Embodiment>

Figure 11:
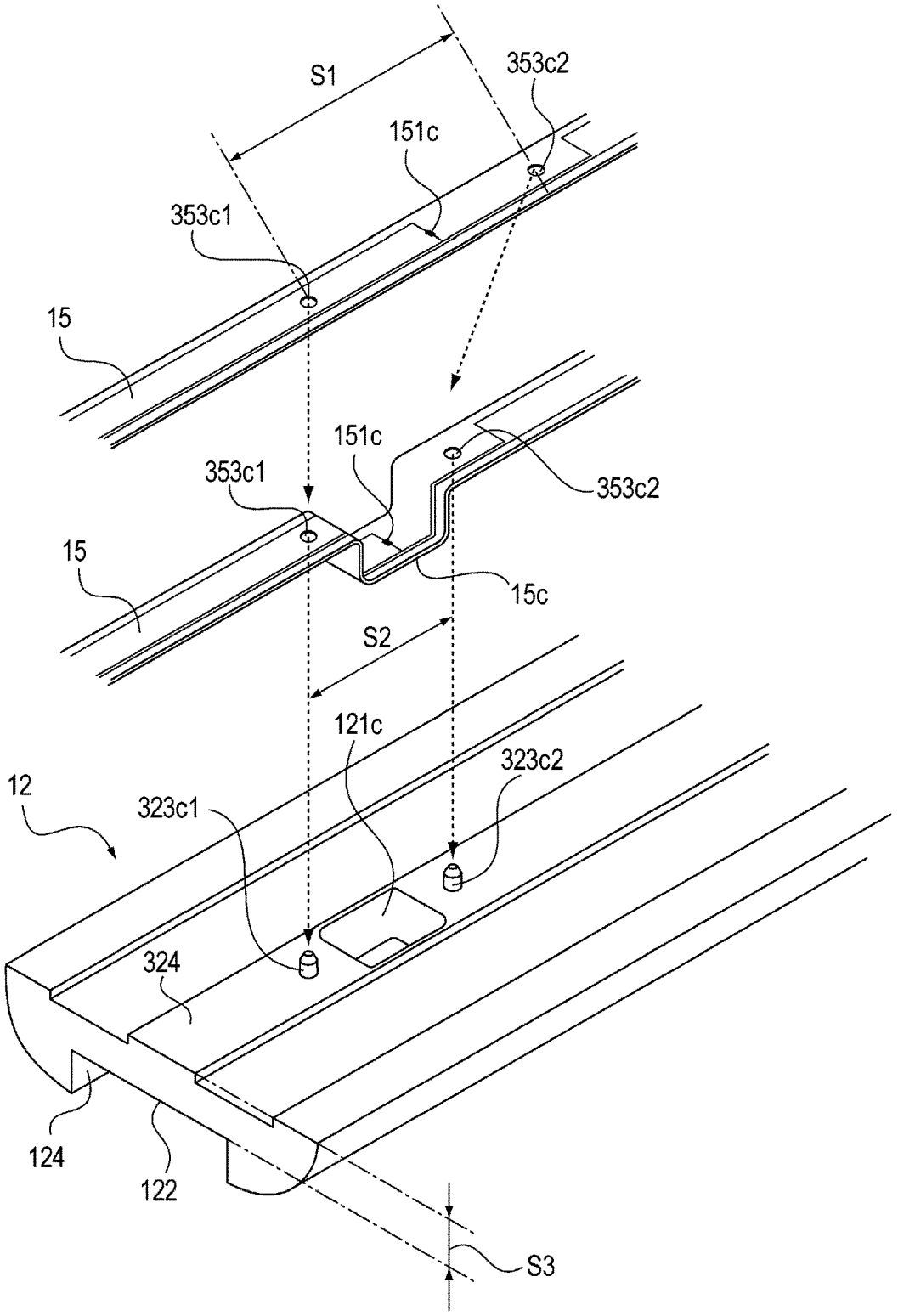
FIG. 11 is an exploded perspective view showing structures of a heat insulating holder and a temperature detecting member in Third Embodiment at a place connect the C-C position of FIG. 3.

Next, structures of a temperature detecting member, in image heating apparatus and an image forming apparatus according to the present invention in Third Embodiment will be described using FIG. 11. Incidentally, members or portions constituted similarly as those in the above-described respective embodiments will be omitted from description by adding the same reference numerals or symbols or the same member names even when the symbols are different. FIG. 11 is a sectional illustration showing structures of a heat insulating holder and a temperature detecting member 15 in Third Embodiment at a place corresponding to C-C position in FIG. 3. The temperature detecting member 15 is provided on a sensor disposing surface 324 which is a surface of the heat insulating holder 12 in a side opposite from the heater disposing surface 122 provided in the groove 124 of the heat insulating holder 12.

In the heat insulating holder 12 (supporting member) in this embodiment, as described above with reference to FIG. 5, the four through holes 21*a*-121*d* are provided along the longitudinal direction of the heat insulating holder 12. The heat insulating holder 12 supports the temperature detecting member 15 in one opening side of each of the through holes 121*a*-121*d* and supports the heater 11 (heating member, object) in the other opening side of each of the through holes 121*a*-121*d*.

The temperature detecting member 15 has flexibility, and a portion where an associated one of the temperature-sensitive elements 151*a*-151*d* is flexed (bent) as shown in FIG. 11 and then is inserted from an associated one opening side (upper side in FIG. 11) of the through holes 121*a*-121*d* in an associated one of the through holes 121*a*-121*d*. As a result, projected portions 15*a*-15*d*, each having a hat shape in cross section, which project from the other opening sides (lower side in FIG. 11) of the through holes 121*a*-121*d* toward the heater 11 (heating member, object) are formed. By inserting the projected portions 15*a*-15*d* in the through holes 121*a*-121*d* of the heat insulating holder 12, it is possible to carry out positioning (positional alignment) of the temperature detecting member 15 relative to the heat insulating holder 12 with respect to the longitudinal direction and the widthwise direction.

The positioning is carried out in a similar constitution at the four places of the temperature-sensitive elements 151*a*-151*d*. In FIG. 11, a constitution in which the projected portion 15*c* formed by flexing the portion of the temperature-sensitive element 151*c* at the place of the temperature detecting member 15 corresponding to the C-C position in FIG. 3 is inserted in the through hole 121*c* of the heat insulating holder 12 and thus is positioned will be described.

As shown in FIG. 11, in both sides of the through hole 121*c* of the heat insulating holder 12 along the longitudinal direction, projected portions 323*c*1 and 323*c*2 projected from the sensor disposing surface 324 are provided. Further, in both sides of the temperature-sensitive element 151*c* of the temperature detecting member 15 along the longitudinal direction, through holes 353*c*1 and 353*c*2 for positioning are provided. A center interval S1 between the positioning through holes 353*c*1 and 353*c*2 which are circular holes provided in the temperature detecting member 15 is set in the following manner. A center interval S2 between cylindrical positioning projected portions 323*c*1 and 323*c*2 provided on the heat insulating holder 12 is taken into consideration. Further, a distance S3, which is a thickness, between the heater disposing surface 122 and the sensor disposing surface 324 which are provided on the heat insulating holder 12 is taken into consideration. The center interval S1, the center interval S2 and the distance S3 are set in the following relationship.

$$S1 \approx S2 + S3 \times 2$$

As shown in FIG. 11, the flexible temperature detecting member 15 is flexed with the portion of the temperature-sensitive element 151*c* as a center, so that the projected portion 15*c* having the hat shape in cross section is formed. Then, the projected portion 15*c* is inserted into the through hole 121*c* of the heat insulating holder 12. In that state, the projected portions 323*c*1 and 323*c*2 are inserted into the through holes 353*c*1 and 353*c*2 and are loosely engaged movably.

As a result, the position of the temperature detecting member 15 with respect to the longitudinal direction and the widthwise direction is determined relative to the heat insulating holder 12. Then, similarly as in the above-described First Embodiment shown in (a) of FIG. 6, the projected portion 15*c* of the temperature detecting member 15 is urged in the direction of the heater 11 by using the elastic member 18 (urging means) and the pressing member 17. As a result, the portion of the temperature-sensitive element 151*c* provided at the projected portion of the temperature detecting member 15 contacts the heater 11 (object) with reliability. For this reason, temperature detection of the heater 11 can be stably carried out by the temperature-sensitive elements 151*c*.

In this embodiment, compared with the above-described First Embodiment shown in (a) of FIG. 6, the temperature detecting member 15 does not exist between the heater 11 and the heat insulating holder 12. For this reason, the heater 11 can be adhesively fixed to the heat insulating holder 12. In First Embodiment described above, the position of the heater 11 relative to the heat insulating holder 12 was fixed by sandwiching the longitudinal end portions of the heater 11 together with the heat insulating holder 12 by the heater clip. In this embodiment, the temperature detecting member 15 does not exist between the heater 11 and the heat insulating holder 12, and therefore, the heater 11 is adhesively fixed to the heat insulating holder 12, so that the heater 11 can be fixed with high accuracy.

Also in this embodiment, the realization of the downsizing and the thermal capacity reduction of the fixing device 10 in comparison with the above-described comparison example with reference to FIGS. 8 and 9 is similar to that in the above-described First Embodiment. Other constitutions are similar to those in the above-described First Embodiment, so that a similar effect can be obtained. Further, when constitutions similar to those in Fifth and Sixth Embodiments described later are employed, it is also possible to obtain similar effects.

<Fourth Embodiment>

Figure 12:
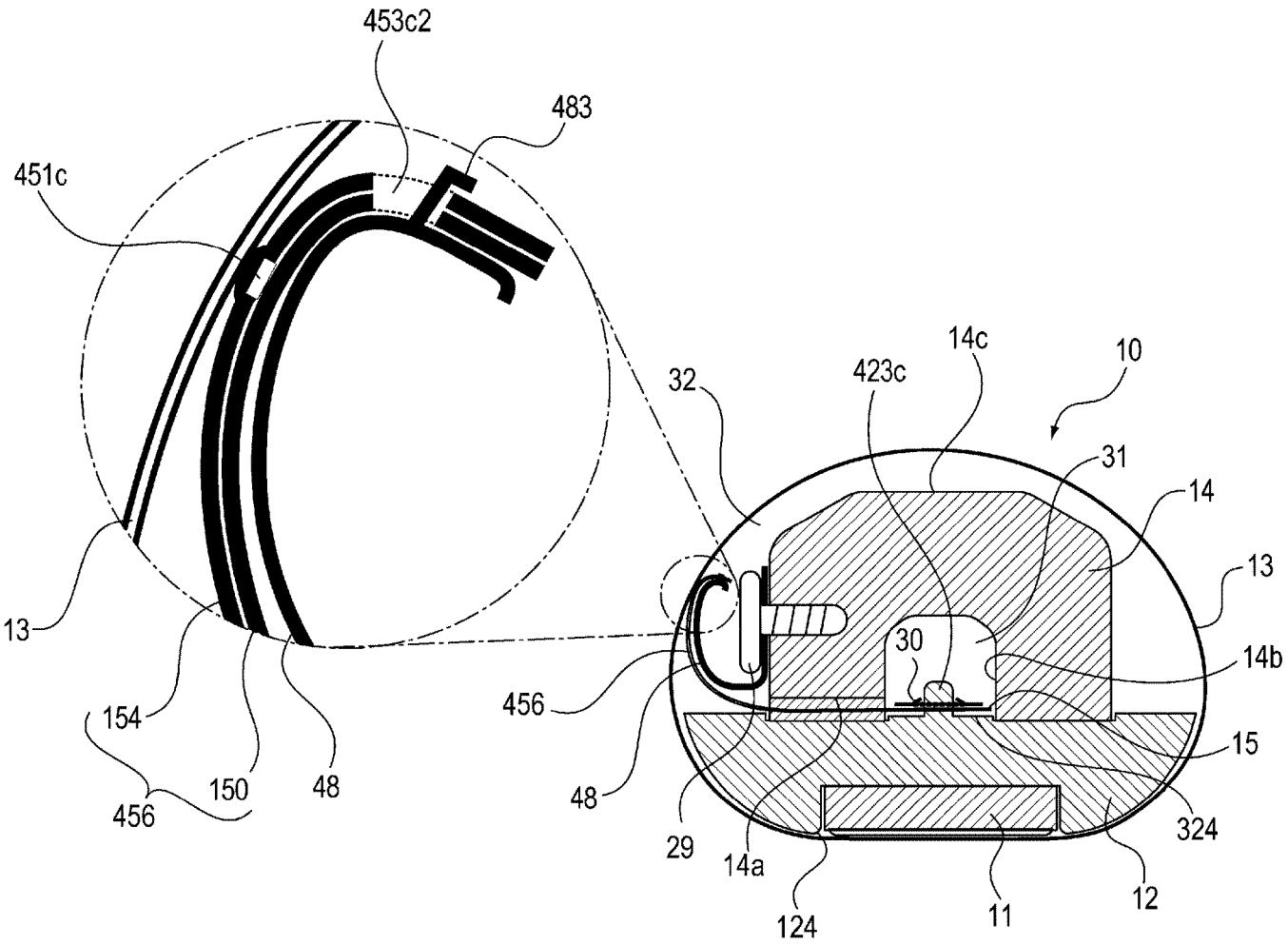
FIG. 12 is a sectional illustration showing a structure of a fixing assembly in Fourth Embodiment at a place connect the C-C position of FIG. 3.
Figure 13:
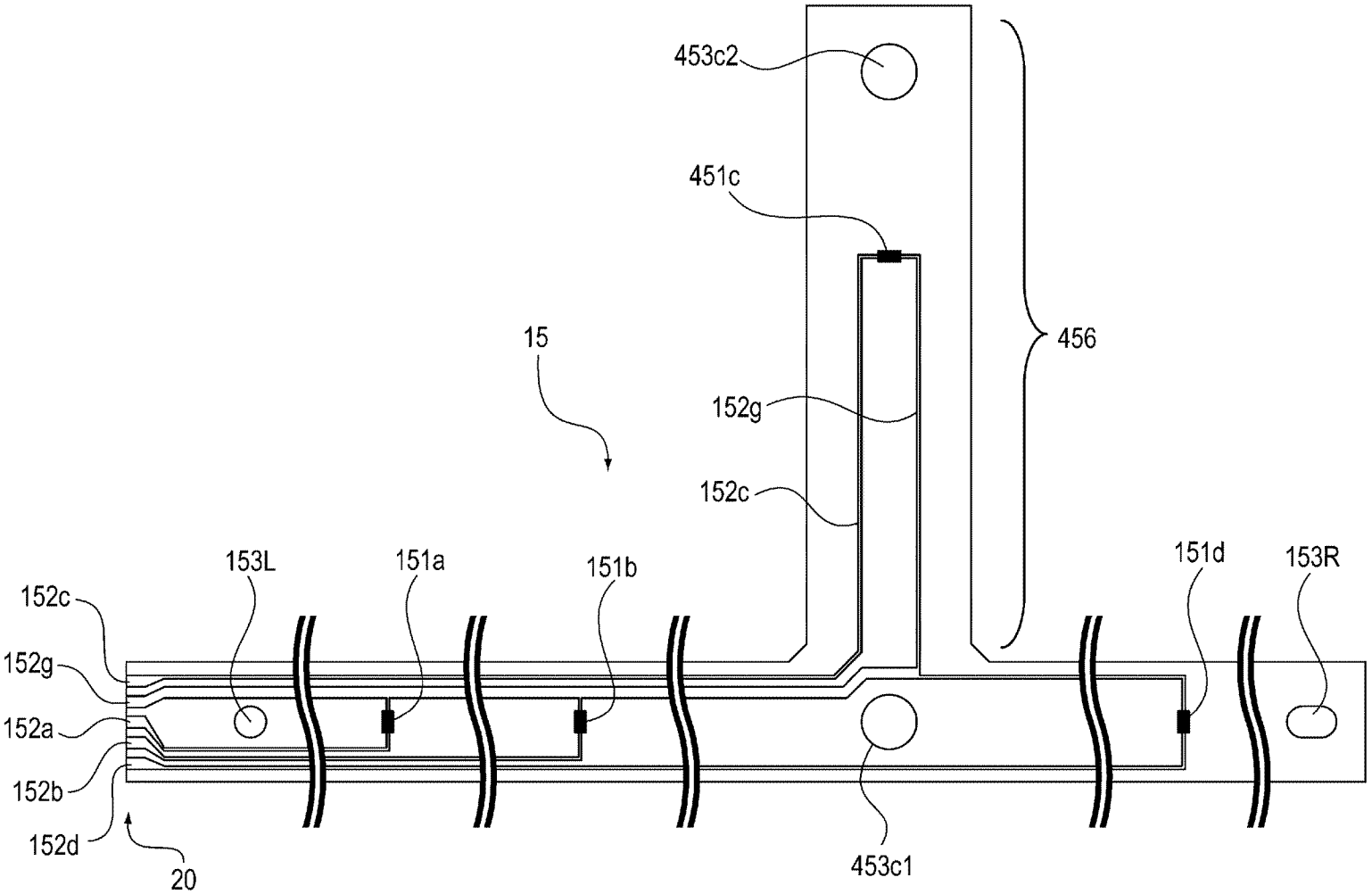
FIG. 13 is a bottom illustration of a temperature detecting member in Fourth Embodiment as seen from a pressing roller side.

Next, structures of a temperature detecting member, in image heating apparatus and an image forming apparatus according to the present invention in Fourth Embodiment will be described using FIGS. 12 and 13. Incidentally, members or portions constituted similarly as those in the above-described respective embodiments will be omitted from description by adding the same reference numerals or symbols or the same member names even when the symbols are different. FIG. 12 is a sectional illustration showing a structure of a fixing assembly 10 in this embodiment at a place corresponding to C-C position in FIG. 3. FIG. 13 is a bottom illustration of the temperature detecting member 15 in this embodiment as seen from the pressing roller 16 side.

In the above-described embodiments, the temperature of the heater 11 was detected by the temperature-sensitive elements 151*a*-151*d* of the temperature detecting member shown in FIG. 3. A temperature detecting member 15 in this embodiment is constituted, as shown in FIG. 13, in a T-shape as a whole such that a branch portion 456 branches off from a portion where the temperature-sensitive element 151*c* in the above-described Third Embodiment was disposed. Further, in place of the temperature-sensitive element 15*c* of the temperature detecting member 15 shown in FIG. 3, by a temperature-sensitive element 451*c* provided at the branch portion 456 of the temperature detecting member 15 shown in FIG. 13, the temperature of the fixing film 13 at an inner peripheral surface is detected as shown in FIG. 12. Other constitutions are similar to those in the above-described Third Embodiment, and therefore, a redundant description will be omitted.

As shown in FIG. 13, with both terminals of the temperature-sensitive element 451*c* provided at the branch portion 456, wiring electroconductors 152*c* and 152*g* are connected, respectively. At a base of the branch portion 456 corresponding to the portion where the temperature-sensitive element 151*c* in the above-described Third Embodiment is disposed, a positioning through hole 453*c*1 is provided. Further, at a free end portion of the branch portion 456, another positioning through hole 453*c*2 is provided.

On the other hand, on the sensor disposing surface 324 of the heat insulating holder 12 shown in FIG. 12, a projected portion 423*c* projecting toward the stay 14 side is provided. The projected portion 423 in this embodiment is provided at a place corresponding to the position where the through hole 121*c* of the heat insulating holder 12 in the above-described First Embodiment shown in FIG. 5. The projected portion 423*c* of the heat insulating holder 12 shown in FIG. 12 is engaged in the through hole 453*c*1 of the temperature detecting member 15 shown in FIG. 13, so that the temperature detecting member 15 is fixed to the heat insulating holder 12.

As shown in FIG. 12, the branch portion 456 of the temperature detecting member 15 is inserted into and passed through a cut-away portion 14*a*, provided in the stay 14, from a space 31 defined by the heat insulating holder 12 and an inner peripheral surface, of the stay 14, having a U-shape in cross section. Then, the branch portion 456 is pulled out to a space 32 defined by an outer peripheral surface 14*c* of the stay 14, the heat insulating holder 12 and the inner peripheral surface of the fixing film 13.

The portion of the temperature-sensitive element 451*c* provided at the branch portion 456 of the temperature detecting member 15 is urged toward the inner peripheral surface of the fixing film 13 (object) by an urging member (urging means) consisting of a spring plate provided on the stay 14 as a supporting means. The urging member 48 is formed, for example, by bending a flexible thin metal plate. One end portion of the urging member 48 is fixed to the stay 14 with a fixing screw 29 or the like.

Further, as shown in FIG. 12, at the other end portion of the urging member 48, a retaining portion 483 formed by cutting and raising the spring plate is provided. In the through hole 453*c* provided at a free end portion of the branch portion 456 of the temperature detecting member 15 shown in FIG. 13, as shown in FIG. 12, the retaining portion 483 of the urging member 48 is inserted and locked. As a result, the branch portion 4456 of the temperature detecting member 15 is provided between the projected portion 423*c* projecting from the sensor disposing surface 324 of the heat insulating holder 12 and the retaining portion 483 of the urging member 48 fixed on the stay 14.

In this embodiment, by the temperature-sensitive element 451*c* provided at the branch portion 456 of the temperature detecting member 15, it is possible to detect the temperature of the inner peripheral surface of the fixing film 13 directly conducting the heat to the recording material P in contact with the recording material P by the temperature-sensitive element 451*e*. As a result, in this embodiment, the temperature of the fixing device 6 as the image heating apparatus can be controlled to a proper toner image heating temperature with accuracy higher than those in the above-described First to Third Embodiments.

Further, the realization of the downsizing and the thermal capacity reduction of the fixing device 10 in comparison with the above-described comparison example with reference to FIGS. 8 and 9 is similar to that in the above-described First Embodiment. Other constitutions are similar to those in the above-described embodiments, so that a similar effect can be obtained.

<Fifth Embodiment>

Figure 14:
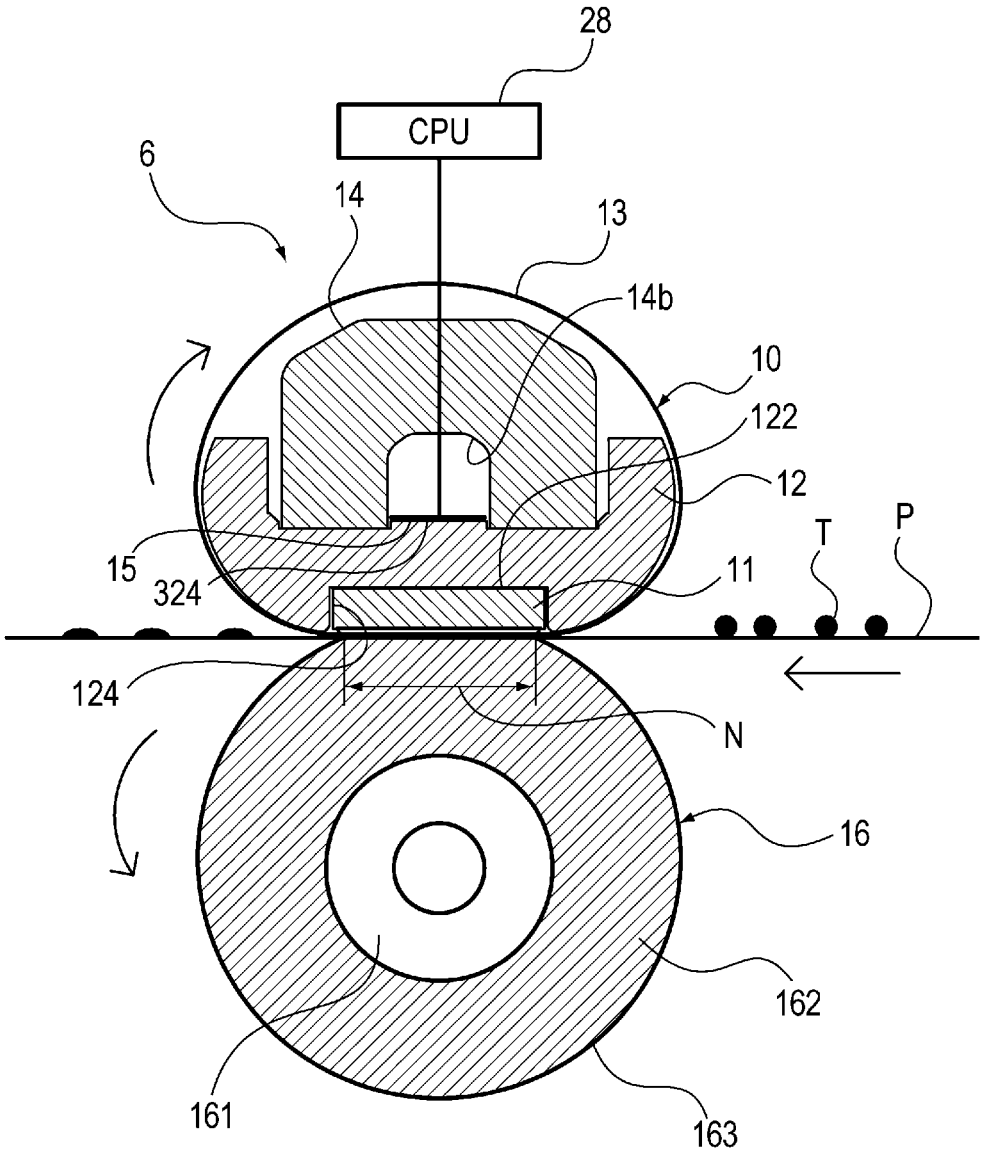
FIG. 14 is a sectional illustration showing a structure of an image heating apparatus in Fifth Embodiment.
Figure 15:
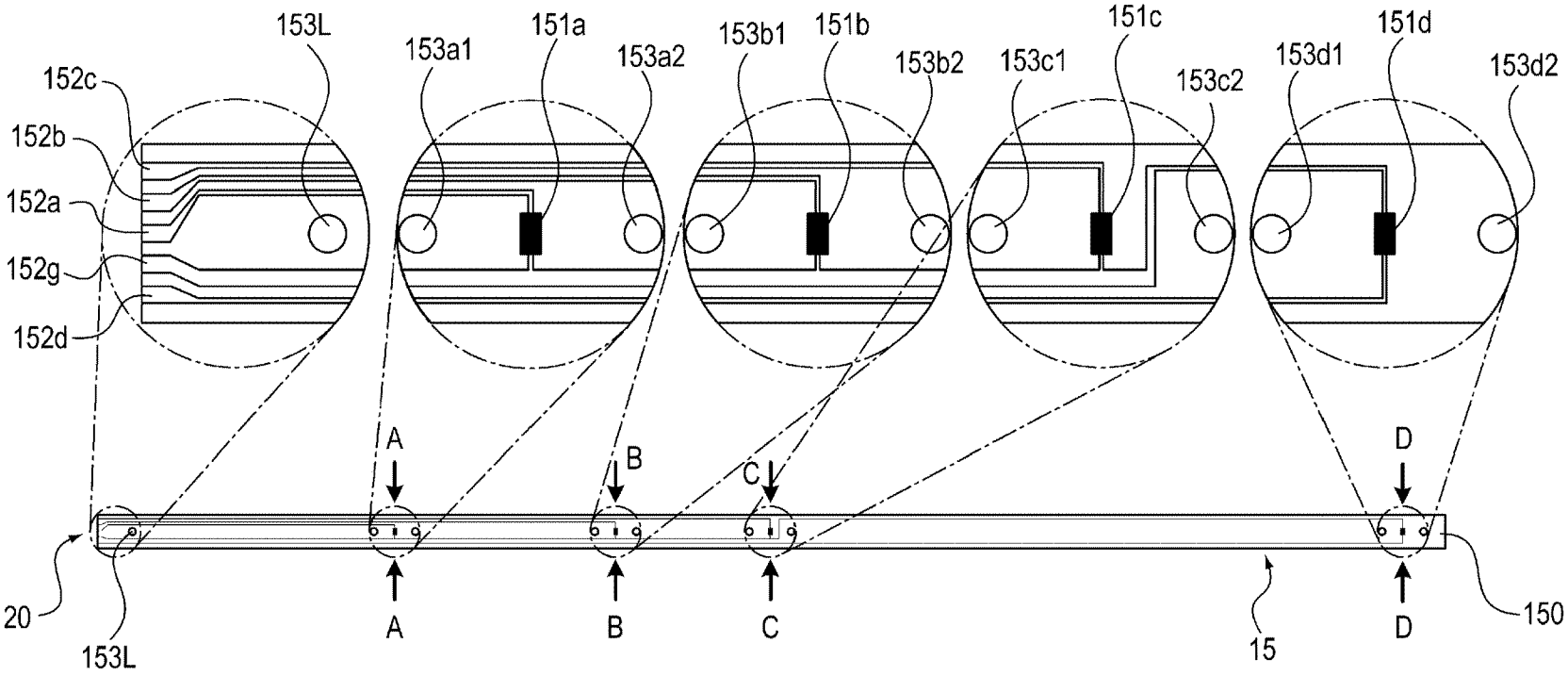
FIG. 15 is a bottom illustration of a temperature detecting member in Fifth Embodiment as seen from a pressing roller side.

Next, structures of a temperature detecting member, in image heating apparatus and an image forming apparatus according to the present invention in Fifth Embodiment will be described using FIGS. 14-19. Incidentally, members or portions constituted similarly as those in the above-described embodiments will be omitted from description by adding the same reference numerals or symbols or the same member names even when the symbols are different. FIG. 14 is a sectional illustration showing a structure of the image heating apparatus in Fifth Embodiment. FIG. 15 is a bottom illustration of the temperature detecting member in this embodiment as seen from the pressing roller side. In FIG. 16, (a) is a sectional view of A-A in FIG. 15, (b) is a sectional view of B-B in FIG. 15, (c) is a sectional view of C-C in FIG. 15, and (d) is a sectional view of D-D in FIG. 15.

Figure 17:
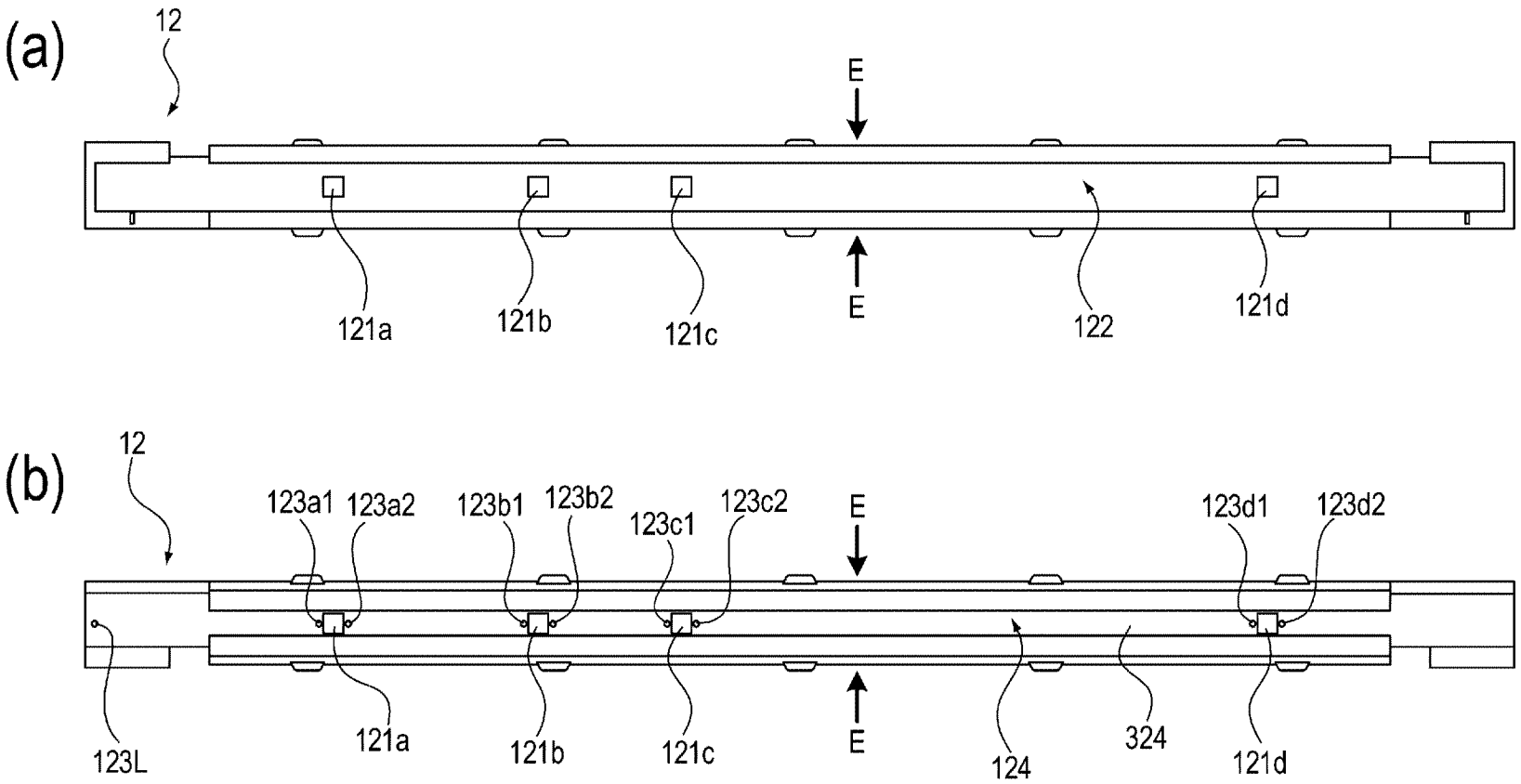
In FIG. 17, (a) is a bottom showing a structure of a heat insulating holder in Fifth Embodiment as seen from the pressing roller side, and (b) is a plan illustration of a heat insulating holder in Fifth Embodiment as seen from a stay side.
Figure 19:
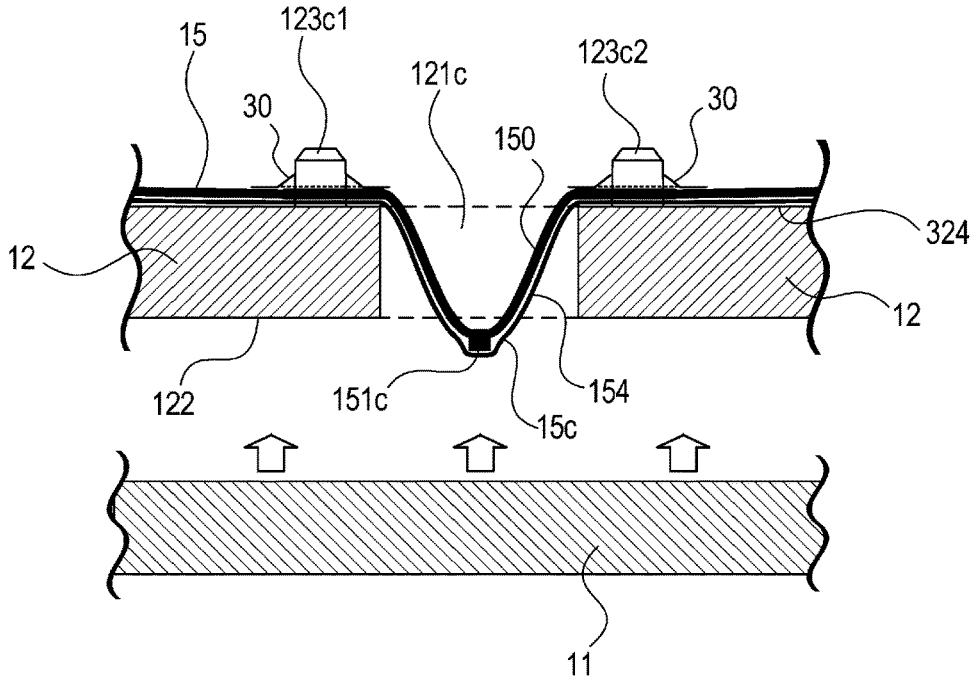
In FIG. 19, (a) is an exploded sectional view showing structures of a heat insulating holder, a temperature detecting member and a heater in Fifth Embodiment at a place connect the C-C position of FIG. 15, and (b) is a sectional illustration showing structures of a heat insulating holder, a temperature detecting member and a heater in Fifth Embodiment at a place connect the C-C position of FIG. 15.
Figure 19:
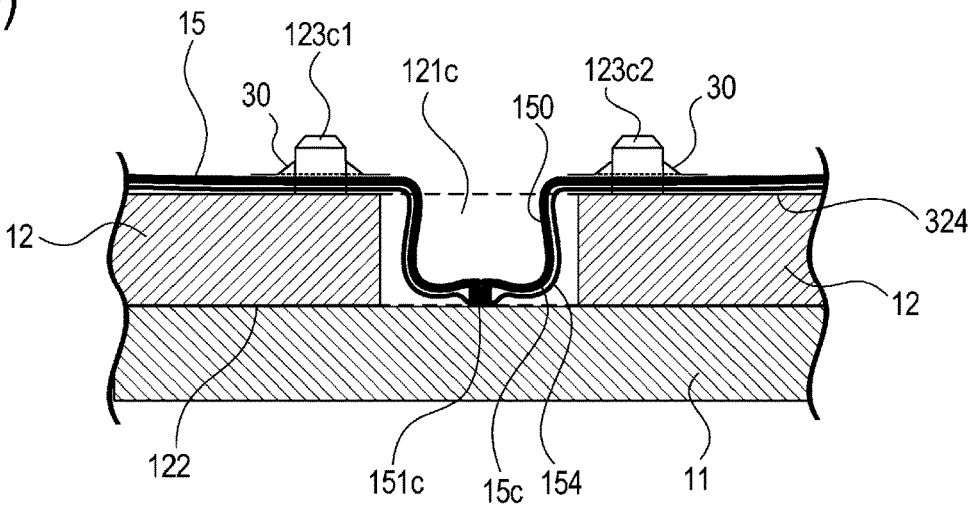

In FIG. 17, (a) is a bottom illustration of the heat insulating holder 12 in this embodiment as seen from the pressing roller side, and (b) is a plan illustration of the heat insulating holder 12 in this embodiment as seen from the stay 14 side. FIG. 8 is an exploded perspective view showing structures of the heat insulating holder 12 and the temperature detecting member in this embodiment at a place corresponding to the C-C position in FIG. 15. In FIG. 19, (a) is an exploded sectional view showing structures of the heat insulating holder 12, the temperature detecting member and the heater at a place corresponding to the C-C position in FIG. 15, and (b) is a sectional illustration showing the structures of the heat insulating holder 12, the temperature detecting member and the heater at the place corresponding to the C-C position in FIG. 15.

In this embodiment, a constitution similar to the above-described Third Embodiment shown in FIG. 11. As shown in FIG. 14, the temperature detecting member 15 provided in the fixing assembly 10 in this embodiment is provided on the sensor disposing surface 324 in the stay 14 side of the heat insulating holder 12. The temperature detecting member 15 in this embodiment detects the temperature of the ceramic substrate and outputs signal depending on the detected temperature.

Incidentally, in the following description, the direction parallel to the feeding direction of the recording material P at the fixing nip is referred to as the widthwise direction of the temperature detecting member 15. Further, the direction parallel to the core metal 161 as a rotation shaft of the pressing roller 16 is referred to as the longitudinal direction of the temperature detecting member 15. Further, the direction perpendicular to not only the widthwise direction of the temperature detecting member 15 but also the longitudinal direction of the temperature detecting member 15 is referred to as a thickness direction. Also with regard to the heater 11 and the heat insulating holder 12, the above-described directions are referred to as the widthwise direction, the longitudinal direction and the thickness direction, respectively.

The base layer 150 of the temperature detecting member 150 shown in (a) to (d) of FIG. 16 is formed of a resin material having the heat-resistant property and the electrically insulating property in a sheet shape of about 10-200 μm in thickness. As the base layer 150, it is possible to use polyimide (PI), polyamideimide (PAI), polyether ether ketone (PEEK), polyethyleneterephthalate (PET), epoxy resin and the like. As the base layer 150 in this embodiment, a polyimide film of 100 μm in thickness t2 is used.

Further, as shown in (a) and (b) of FIG. 17, a plurality of through holes 121*a*-121*d* are provided at positions corresponding to portions of temperature-sensitive elements 151*a*-151*d* provided on the temperature detecting member 15 along the longitudinal direction of the heat insulating holder 12. The through holes 121*a*-121*d* are provided at the positions corresponding to the temperature-sensitive elements 151*a*-151*d*, respectively.

As shown in (b) of FIG. 19, the heat insulating holder 12 as the supporting member supports the temperature detecting member 15 in one opening side (upper side of (b) of FIG. 19) of the through holes 121*a*-121*d*. Further, the heat insulating holder 12 supports the heater 11 (heating member, object) in the other opening side (lower side of (b) of FIG. 19) of the through holes 121*a*-121*d*.

Figure 18:
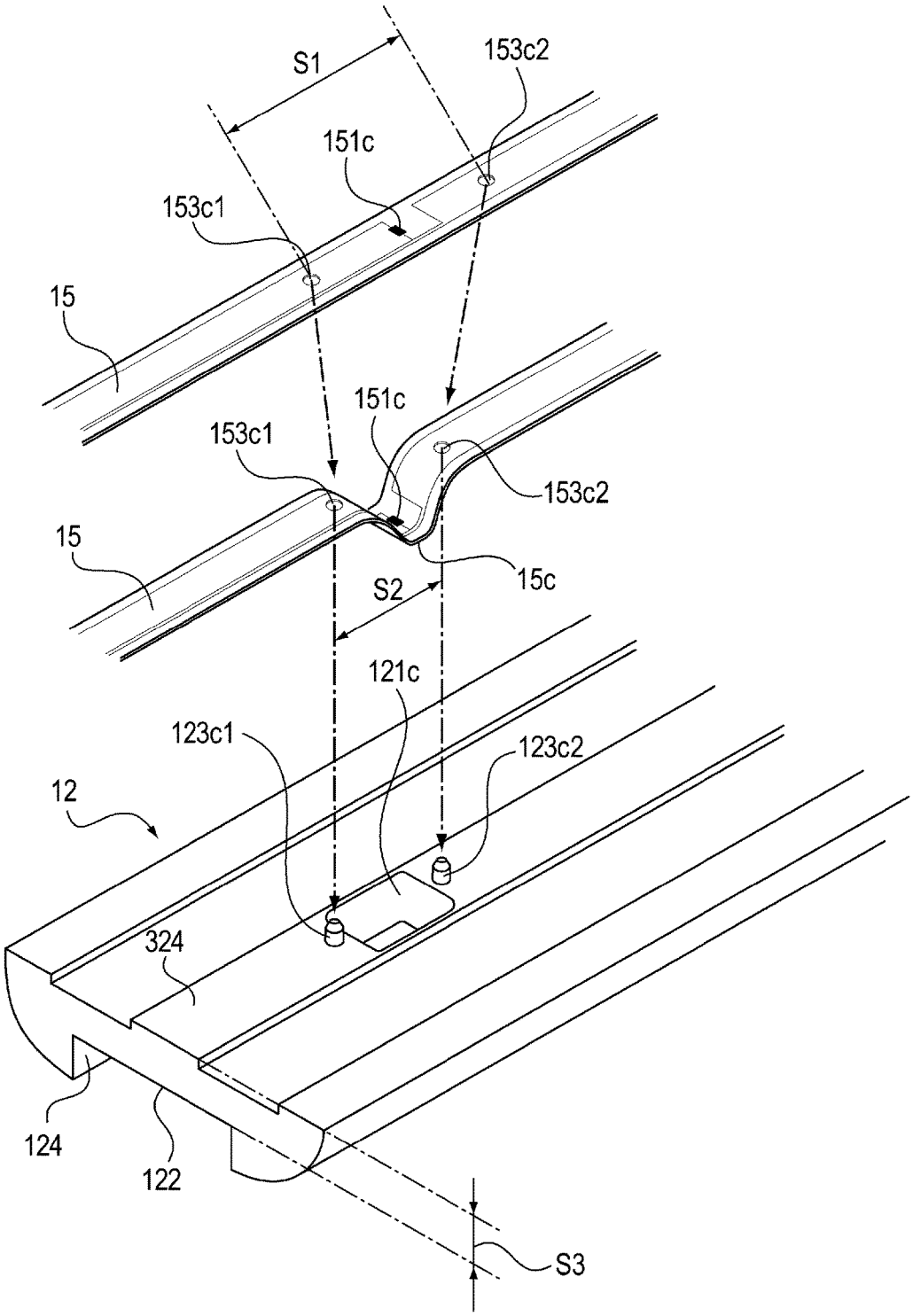
FIG. 18 is an exploded perspective view showing structures of a heat insulating holder and a temperature detecting member in Fifth Embodiment at a place connect the C-C position of FIG. 15.

As regards the temperature detecting member 15 in this embodiment, positioning with respect to the longitudinal direction and the widthwise direction is carried out in the neighborhoods of the four through holes 121*a*-121*d* provided in the heat insulating holder 12. The positioning is carried out similarly at the four places in the neighborhoods of the through holes 121*a*-121*d*, and therefore in this embodiment, as a representative, a positioning method of the temperature detecting member 15 in the neighborhood of the through hole 121*c* will be described. As shown in FIG. 18, in both sides of the through hole 121*c* along the longitudinal direction of the heat insulating holder 12, projected portions 123*c*1 and 123*c*2 for positioning the temperature detecting member 15 are provided in a projected state.

Further, as shown in FIG. 15, the through holes 153*c*1 and 153*c*2 are provided along the longitudinal direction of the temperature detecting member 15. The through holes 153*c*1 and 153*c*2 are formed along the longitudinal direction of the temperature detecting member 15 in a positional relationship such that the temperature-sensitive element 151*c* is sandwiched therebetween. Incidentally, as shown in FIG. 15, along the longitudinal direction of the temperature detecting member 15, also through holes 153*a*1, 153*a*2, 153*b*1, 153*b*2, 153*d*1 and 153*d*2 are similarly provided. The respective through holes 153*c*1, 153*c*2, 153*b*1, 153*b*2, 153*d*1 and 153*d*2 are formed along the longitudinal direction of the temperature detecting member 15 in positional relationships such that the temperature-sensitive elements 151*a*, 151*b* and 151*d* are sandwiched between associated through holes.

As shown in FIG. 18, in a natural state in which the temperature detecting member 15 is stretched linearly in the longitudinal direction, setting is made in the following manner. A center interval S1 of the through holes 153*c*1 and 153*c*2, which are circular holes, with respect to the longitudinal direction of the temperature detecting member 15 is taken into consideration. Further, a center interval S2 of the projected portions 123*c*1 and 123*c*2, which are cylindrical portions, with respect to the longitudinal direction of the heat insulating holder 12 is taken into consideration. The center interval S1 is set so as to be longer than the center interval S2.

As shown in FIG. 18, the flexible temperature detecting member 15 is flexed with the portion of the temperature-sensitive element 151*c* as a center, so that a V-shaped projected portion 15*c* is formed. Then, the projected portion 15*c* is inserted into the through hole 121*c* from one opening side (upper side of FIG. 18) of the through hole 121*c* of the heat insulating holder 12. As a result, the projected portion 15*c* projects toward the heater 11 (heating member, object) from the other opening side (lower side of (a) of FIG. 19). As a result, the position of the temperature detecting member 15 relative to the heat insulating holder 12 with respect to the longitudinal direction and the widthwise direction is determined.

As shown in FIG. 15, in the neighborhood of one end portion (left-hand end portion of FIG. 15) of the temperature detecting member 15 with respect to the longitudinal direction, a positioning through hole 153L is provided. Further, as shown in (b) of FIG. 17, on the sensor disposing surface 324 where the temperature detecting member 15 is disposed on the heat insulating holder 12, a projected portion 123L is provided at a position corresponding to the through hole 153L of the temperature detecting member 15 shown in FIG. 15. The projected portion 123L of the heat insulating holder 12 is engaged in the through hole 153L of the temperature detecting member 15. As a result, the position of the temperature detecting member 15 relative to the heat insulating holder 12 at the longitudinal end portion is determined.

Depending on a restoring force of the flexible temperature detecting member itself, there is also a possibility that the projected portions 123*c*1 and 123*c*2 of the heat insulating holder 12 slip out of the through holes 153*c*1 and 153*c*2 of the temperature detecting member 15. In order to prevent this, in this embodiment, from above the through holes 153*c*1 and 153*c*2 of the temperature detecting member 15, push nuts 30 shown in (a) and (b) of FIG. 19 are fitted and locked to the projected portions 123*c*1 and 123*c*2 of the heat insulating holder 12. As a result, the temperature detecting member 15 is locked to a periphery of the through hole 121*c* of the heat insulating holder 12 (supporting member) in one opening side (upper side of FIG. 18).

A longitudinal end portion of the temperature detecting member 15 in a side where the through hole 153L is provided is pulled out to a position, outside the fixing assembly 10 shown in FIG. 14, where the heat-resistant properly is not relatively required. At this end portion, as shown in FIG. 15, a contact portion 20 where one end portions of the respective wiring electroconductors 152*a*-152*d* and 152*g* are concentrated is provided. By connecting an unshown energization connector with this contact portion 20, signals of the temperature-sensitive elements 151*a*-151*d* provided on the temperature detecting member 15 are sent to the CPU 28 as the control means provided in the image forming apparatus 19.

As shown in (a) of FIG. 19, the temperature detecting member 15 is disposed on the sensor disposing surface 324 of the heat insulating holder 12. Thereafter, as shown in (b) of FIG. 19, the heater 11 is disposed on the heater disposing surface 122 of the heat insulating holder 12. In a state shown in (b) of FIG. 19, the portion of the temperature-sensitive element 151*c* positioned at the top of the projected portion 15*c* of the temperature detecting member 15 inserted into the through hole 121*c* of the heat insulating holder 12 projects toward the pressing roller 16 side (downward side of (a) of FIG. 19).

In the state of (a) of FIG. 19, in order to dispose the heater 11 on the heater disposing surface, the heater 11 is contacted to the portion of the temperature-sensitive element 121*c* positioned at the top of the projected portion 15*c* of the temperature detecting member 15 and is pressed upwardly in (a) of FIG. 15 against an elastic force of the temperature detecting member 15. Then, the portion of the temperature-sensitive element 121*c* of the temperature detecting member 15 is pushed by the heater 11, so that the projected portion 15*c* of the flexible temperature detecting member 15 is elastically deformed in a hat shape in cross section shown in (b) of FIG. 19 from the V shape in cross section shown in (a) of FIG. 19. As a result, the projected portion 15*c* of the temperature detecting member 15 is embedded in the through hole 121*c* of the heat insulating holder 12 and thus is accommodated in a state shown in 8*b*) of FIG. 19.

At this time, the temperature detecting member 15 is flexed, so that the base layer 150 and the insulating layer 154 causes distortion due to flexual deformation of the temperature detecting member 15. A restoring force acts on the base layer 150 and the insulating layer 154 in a direction of eliminating this distortion. By this restoring force of the temperature detecting member 15 itself, as shown in (b) of FIG. 19, the portion of the temperature-sensitive element 151*c* is urged in the direction of the heater 11 (heating member, portion-to-be-detected). As a result, the portion of the temperature-sensitive element 151*c* is contacted to the heater 11 with reliability. For this reason, toner detection of the heater 11 can be stably performed by temperature-sensitive element 151*c*.

Further, onto the contact surface of the projected portion 15*c* of the temperature detecting member 15 with the heater 11, heat-resistant grease may also be applied. As a result, contact heat resistance between the temperature detecting member 15 and the heater 11 can be lowered. As a result, responsiveness of the temperature-sensitive elements 151*a*-151*d* of the temperature detecting member 15 can be enhanced.

Further, as shown in (b) of FIG. 19, after the heater 11 is disposed on the heater disposing surface 122 of the heat insulating holder 12, by an unshown heater clip, longitudinal end portions of the heater 11, the heat insulating holder 12 and the temperature detecting member 15 can be sandwiched and fixed. The heater clip has a function of fixing the position of the heater 11 relative to the heat insulating holder 12 by sandwiching the longitudinal end portions of the heater 11 and the heat insulating holder 12. Incidentally, an energization connector for energizing the energization heat generating layer of the temperature detecting member 15 may also be caused to have the function of the heater clip.

As shown in (a) and (b) of FIG. 19, in this embodiment, the portion of the temperature-sensitive element 151*c* is urged against and contacted to the heater 11 by the restoring force from the flexual deformation. As a result, it is possible to omit the elastic member 18 in the comparison example shown in FIG. 8.

Also in this embodiment, the downsizing and the thermal capacity reduction of the fixing device 10 can be realized in comparison with the above-described comparison example with reference to FIGS. 8 and 9. Other constitutions are similar to those in the above-described embodiments, so that a similar effect can be obtained.

<Sixth Embodiment>

Figure 20:
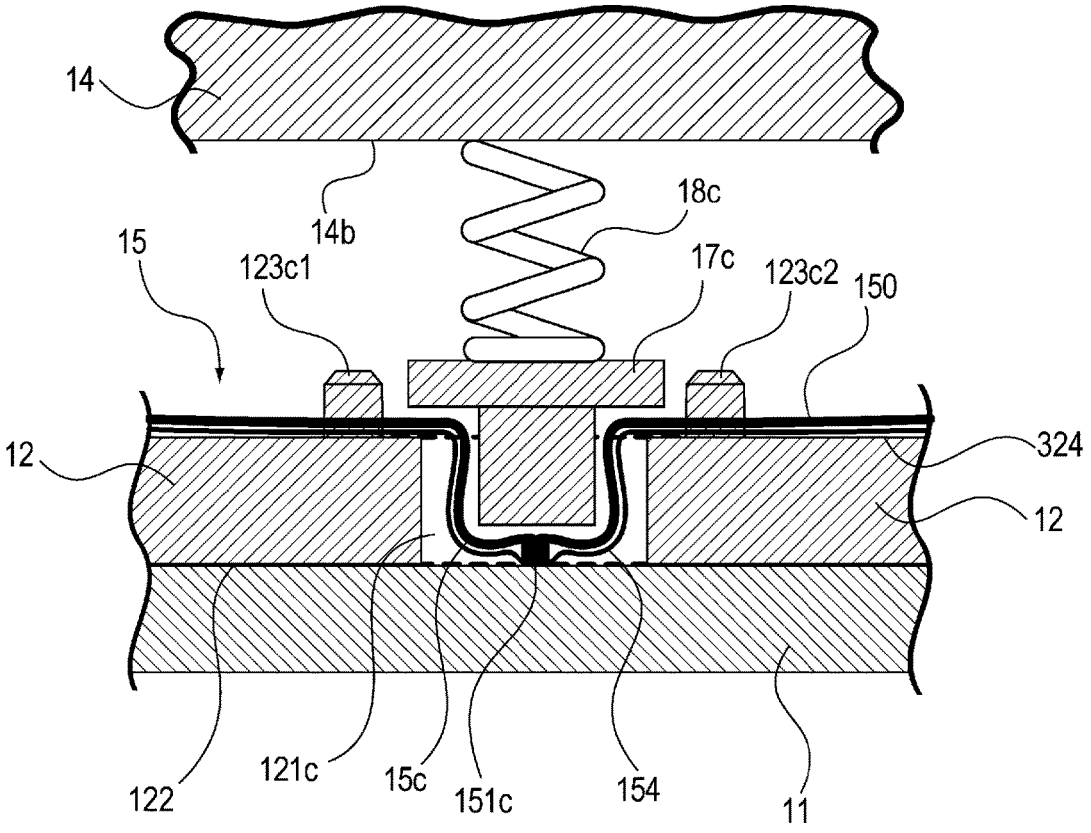
FIG. 20 is a sectional illustration showing a part of a structure of a fixing assembly in Sixth Embodiment at a place connect the C-C position of FIG. 15.

Next, structures of a temperature detecting member, in image heating apparatus and an image forming apparatus according to the present invention in Sixth Embodiment will be described using FIG. 20. Incidentally, members or portions constituted similarly as those in the above-described embodiments will be omitted from description by adding the same reference numerals or symbols or the same member names even when the symbols are different. FIG. 20 is a sectional illustration showing a part of a structure of a fixing assembly 10 in this embodiment at a place corresponding to C-C position in FIG. 15.

In the above-described Fifth Embodiment, as shown in (a) and (b) of FIG. 19, by the restoring force of the flexible temperature detecting member 15 against the flexual deformation, the portions of the temperature-sensitive elements 151*a*-151*d* of the temperature detecting member 15 were urged against and contacted to the heater 11.

However, there is a case that the thicknesses of the base layer 150 and the insulating layer 154 of the temperature detecting member 15 are thin, and depending on the material used, there is a case that the restoring force of the flexible temperature detecting member against the flexual deformation is small. In that case, a sufficient urging force for urging the portion of the temperature-sensitive elements 151*a*-151*d*, provided at the tops of the projected portions 15*a*-15*d* of the temperature detecting member 15, against the heater 11 cannot be ensured in some instances.

In that case, as in this embodiment shown in FIG. 20, the portion of the temperature-sensitive element 151*c* may also be urged against the heater 11 from an inner peripheral surface side of the projected portion 15*c*, having the hat-shape in cross section, of the temperature detecting member 15 by an elastic member 18*c* as an urging means. The elastic member 18*c* is contacted at one end portion thereof to an inner peripheral surface 14*b* of the stay 14 as the supporting member. At the other end portion of the elastic member 18*c*, a pressing member 17*c* is locked. The pressing member 17*c* urges the portion of the temperature-sensitive element 151*c* against the heater 11 from the inner peripheral surface side of the projected portion 15*c*, having the hat shape in consideration, of the temperature detecting member by being urged by the elastic member 18*c*.

At positions of the heat insulating holder 12 corresponding to the through holes 121*a*-121*d* in this embodiment, the pressing members 17*a*-17*d* and the elastic members 18*a*-18*d* are provided, respectively. A similar constitution is employed in the through holes 121*a*-121*d* provided at four places of the heat insulating holder 12, and therefore, in this embodiment, as a representative, the constitution in the neighborhood of the through hole 121*c* shown in FIG. 20 will be described.

As shown in FIG. 20, the elastic member 18*c* is in an elastically compressed state between the pressing member 17*c* and the inner peripheral surface 14*b* of the stay 14. For this reason, by the elastically restoring force of the elastic member 18*c*, the portion of the temperature-sensitive element 151*c* is urged in the direction of the heater 11 from the inner peripheral surface side of the projected portion 15*c*, having the hat shape in cross section, of the temperature detecting member 15 via the pressing member 17*c*. In this embodiment, the push nuts 30 shown in (a) and (b) of FIG. 19 in the above-described First Embodiment can be omitted.

Thus, the portions of the temperature-sensitive elements 151*a*-151*d* provided at the tops of the projected portions 15*a*-15*d* of the temperature detecting member 15 are urged against the heater 11, so that the portions of the temperature-sensitive elements 151*a*-151*d* contact the heater 11 with reliability. For this reason, the temperature of the heater 11 can be stably detected by the respective temperature-sensitive elements 151*a*-151*d*.

Further, it is desirable that the contact surface of the pressing member 17*c* with the temperature detecting member 15 is reduced in contact area to the minimum by being roughened through a creasing process or the like. Thus, the contact heat resistance of the pressing members 17*a*-17*d* against the temperature detecting member can be increased, so that it is possible to prevent unnecessary conduction of heat of the portions of the temperature-sensitive elements 151*a*-151*d* to the pressing members 17*a*-17*d*. For this reason, the temperature detection of the heater 11 can be accurately performed by the respective temperature-sensitive elements 151*a*-151*d*.

Incidentally, in this embodiment shown in FIG. 20, an example in which the elastic member 18*c* (urging means) was constituted by a coil spring was described, but as another means, a leaf spring, a low-hardness rubber member, a porous resin member and the like may also be used as the elastic member 18*c*. As another example, the elastic member 18*c* may also be formed by a felt structure in which fibers such as a nonwoven fabric are interwined with each other in a firmly contracted state or by an elastic structure such as a brush structure in which a large number of fibers or metal wires or the like are planted. Further, when a constitution in which elasticity is imparted to the pressing member 17*c* itself and thus the pressing member 17*c* also has the function as the elastic member 18*c* is employed, the elastic member 18*c* can be omitted.

Also in this embodiment, the realization of the downsizing and the thermal capacity reduction of the fixing device 10 in comparison with the above-described comparison example with reference to FIGS. 8 and 9 is similar to that in the above-described First Embodiment. Other constitutions are similar to those in the above-described First Embodiment, so that a similar effect can be obtained.

<Seventh Embodiment>

Figure 21:
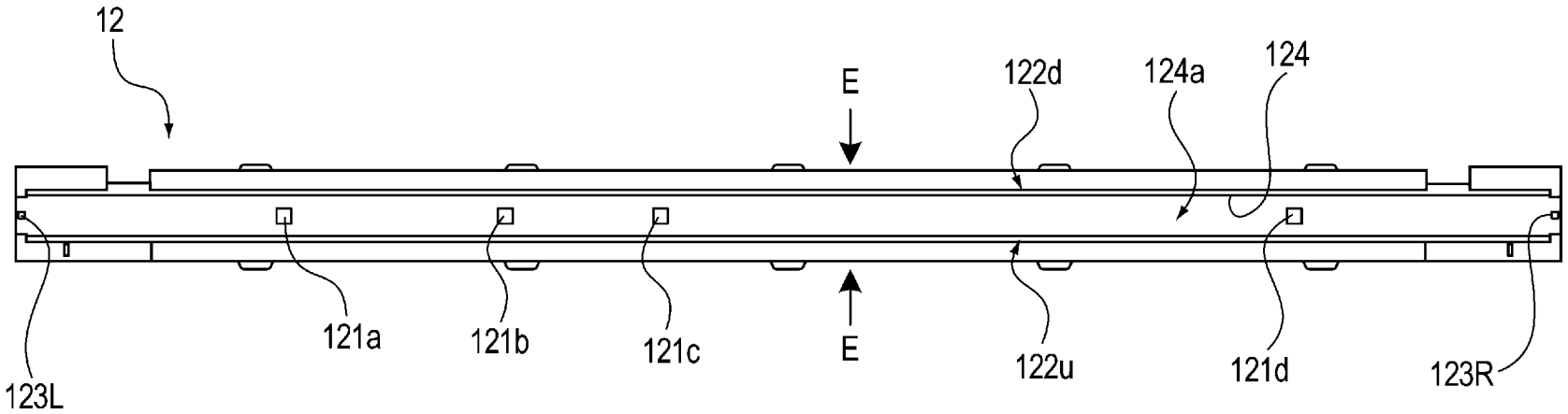
FIG. 21 is a bottom illustration of a heat insulating holder in Seventh Embodiment as seen from a pressing roller side.

Next, structures of a temperature detecting member, in image heating apparatus and an image forming apparatus according to the present invention in Seventh Embodiment will be described using FIG. 21. Incidentally, members or portions constituted similarly as those in the above-described embodiments will be omitted from description by adding the same reference numerals or symbols or the same member names even when the symbols are different. FIG. 21 is a bottom illustration of a heat insulating holder 12 in this embodiment as seen from the pressing roller side. Incidentally, E-E cross-section in FIG. 21 is similar to that in (c) of FIG. 6.

In this embodiment, similarly as in the above-described First Embodiment with reference to FIG. 2, the temperature detecting member 15 is provided between the heat insulating holder 12 and the heater 11. The temperature detecting member 15 in this embodiment is provided on the sensor disposing surface 124*a* which is a bottom of the groove 124 provided in the pressing roller 16 side (lower side of FIG. 2) of the heat insulating holder 12 shown in FIG. 21. The groove 124 is formed along the longitudinal direction of the heat insulating holder 12 shown in FIG. 21. A depth of the groove 124 is larger than a thickness of the temperature detecting member 15, and a width of the groove 124 with respect to the vertical direction in FIG. 21 is broader than a width of the temperature detecting member 15. At longitudinal end portions of the temperature detecting member 15 in this embodiment, as shown in FIG. 3, the through holes 153L and 153R are provided.

Further, at longitudinal end portions of the heat insulating holder, the projected portions 123L and 123R projecting from the sensor disposing surface 124*a* which is the bottom of the groove 124 for positioning the temperature detecting member 15 are provided. The projected portions 123L and 123R of the heat insulating holder 12 are loosely fitted movably in the through holes 153L and 153R of the temperature detecting member 15 shown in FIG. 3, respectively. As a result, the position of the temperature detecting member 15 with respect to the longitudinal direction is determined. It is desirable that the through holes 153L and 153R of the temperature detecting member 15 shown in FIG. 3 are configured so that one through hole 153R thereof is an elongated hole long in the longitudinal direction of the temperature detecting member in view of a dimensional tolerance. In this embodiment, the through hole 153R is the elongated hole.

The temperature detecting member 15 is disposed on the sensor disposing surface 124*a* which is the bottom of the groove 124 of the heat insulating holder 12. Thereafter, the heater 11 is disposed on the heater disposing surfaces 122*u* and 122*d* which are stepped portions provided in the groove 124 of the heat insulating holder 12. Then, by an unshown heater clip, longitudinal end portions of the heat insulating holder 12 and the heater 11 are sandwiched and fixed.

The heater disposing surfaces 122*u* and 122*d* are provided in the groove 124 at end portions of the groove 124 with respect to the widthwise direction (vertical direction in FIG. 21) along the longitudinal direction of the heat insulating holder 12. The heater clip has a function of fixing the position of the heater 11 relative to the heat insulating holder 12 by sandwiching the longitudinal end portions of the heater 11 and the heat insulating holder 12. An energization connector for energizing the energization heat generating layer of the temperature detecting member 15 may also be caused to have the function of the heater clip.

As in this embodiment, the temperature detecting member 15 and the heater 11 are provided in the groove 124 of the heat insulating holder 12, so that the temperature detecting member 15 is loosely supported in a gap between the heater 11 and the sensor disposing surface 124*a* which is the bottom of the groove 124 of the heat insulating holder 12. As a result, a heat insulating layer of air is formed either one or both of between the temperature detecting member 15 and the heater 11 and between the temperature detecting member 15 and the sensor disposing surface 124*a* consisting of the bottom of the groove 124 of the heat insulating holder 12. As a result, heat of the heater 11 is not readily conducted to the heat insulating holder 12, and the heat of the heater 11 can be efficiently conducted to the heater 11 via the fixing film 13, so that the recording material P can be heated.

The temperature detecting member 15 in this embodiment is disposed between the heat insulating holder 12 and the heater 11 in Sixth Embodiment described above with reference to FIG. 20. Further, the portions of the temperature-sensitive elements 151*a*-151*d* of the temperature detecting member 15 are urged in the direction of the action of the elastic members 18*a*-18*d* and the pressing members 17*a*-17*d*.

Further, at the portions of the temperature-sensitive elements 151*a*-151*d* of the temperature detecting member 15, the elastic members 18*a*-18*d* and the pressing members 17*a*-17*d* are provided correspondingly to the through holes 121*a*-121*d* provided in heat insulating holder 12.

As a result, the temperature detecting member 15 contacts the heater 11 with reliability at the portions of the temperature-sensitive elements 151*a*-151*d*. For this reason, temperature detection of the heater 11 can be stably carried out by the temperature-sensitive elements 151*a*-151*d*.

Further, also in this embodiment, the realization of the downsizing and the thermal capacity reduction of the fixing device 10 in comparison with the above-described comparison example with reference to FIGS. 8 and 9 is similar to that in the above-described Sixth Embodiment. Other constitutions are similar to those in the above-described embodiments, so that a similar effect can be obtained.

<Eighth Embodiment>

Next, structures of a temperature detecting member, in image heating apparatus and an image forming apparatus according to the present invention in Eighth Embodiment will be described with reference to FIG. 10 used in the above-described Second Embodiment. Incidentally, members or portions constituted similarly as those in the above-described embodiments will be omitted from description by adding the same reference numerals or symbols or the same member names even when the symbols are different. FIG. 10 described above is a sectional illustration showing a structure of a fixing assembly 10 at a place corresponding to C-C position in FIG. 3.

In this embodiment, in place of the through holes 121*a*-121*d* provided in the heat insulating holder 12 in the above-described Seventh Embodiment shown in FIG. 21, the recessed portion 124*b* is provided continuously to the groove 124. At the bottom 124*c* of the recessed portion 124*b*, a pressing member 27 for urging (pressing) the portion of the temperature-sensitive elements 151*a*-151*d* of the temperature detecting member 15 toward the heater 11 is fixed with an adhesive or a double-coated tape or the like.

The pressing member 27 is a member having the functions of the pressing member 17 and the elastic member 18 shown in FIG. 20 in the above-described Seventh Embodiment. The pressing member 27 is formed with, e.g., a low-hardness rubber, a porous resin material or the like. The pressing member 27 is in an elastically compressed state between the temperature detecting member 15 and the bottom 1214*c* of the recessed portion 124*b* of the heat insulating holder 12, and the temperature detecting member 15 is urged in the direction of the heater 11 by an elastic restoring force of the pressing member 27. Thus, the temperature detecting member 15 is urged in the direction of the heater 11 by the pressing member 27, so that the portions of the temperature-sensitive elements 151*a*-151*d*, the temperature detecting member 15 contact the heater 11 (object) with reliability. For this reason, temperature detection of the heater 11 can be stably carried out by the temperature-sensitive elements 151*a*-151*d*.

In this embodiment, at the portions of the temperature-sensitive elements 151*a*-151*d* of the temperature detecting member 15, the through holes 121*a*-121*d* may also be not provided in the heat insulating holder 12. For this reason, rigidity of the heat insulating holder 12 can be further uniformized. For that reason, compared with the above-described Seventh Embodiment, a further uniform permanent image is readily obtained. Further, the realization of the downsizing and the thermal capacity reduction of the fixing device 10 in comparison with the above-described comparison example with reference to FIGS. 8 and 9 is similar to that in the above-described Seventh Embodiment. Other constitutions are similar to those in the above-described embodiments, so that a similar effect can be obtained.

<Ninth Embodiment>

Figure 22:
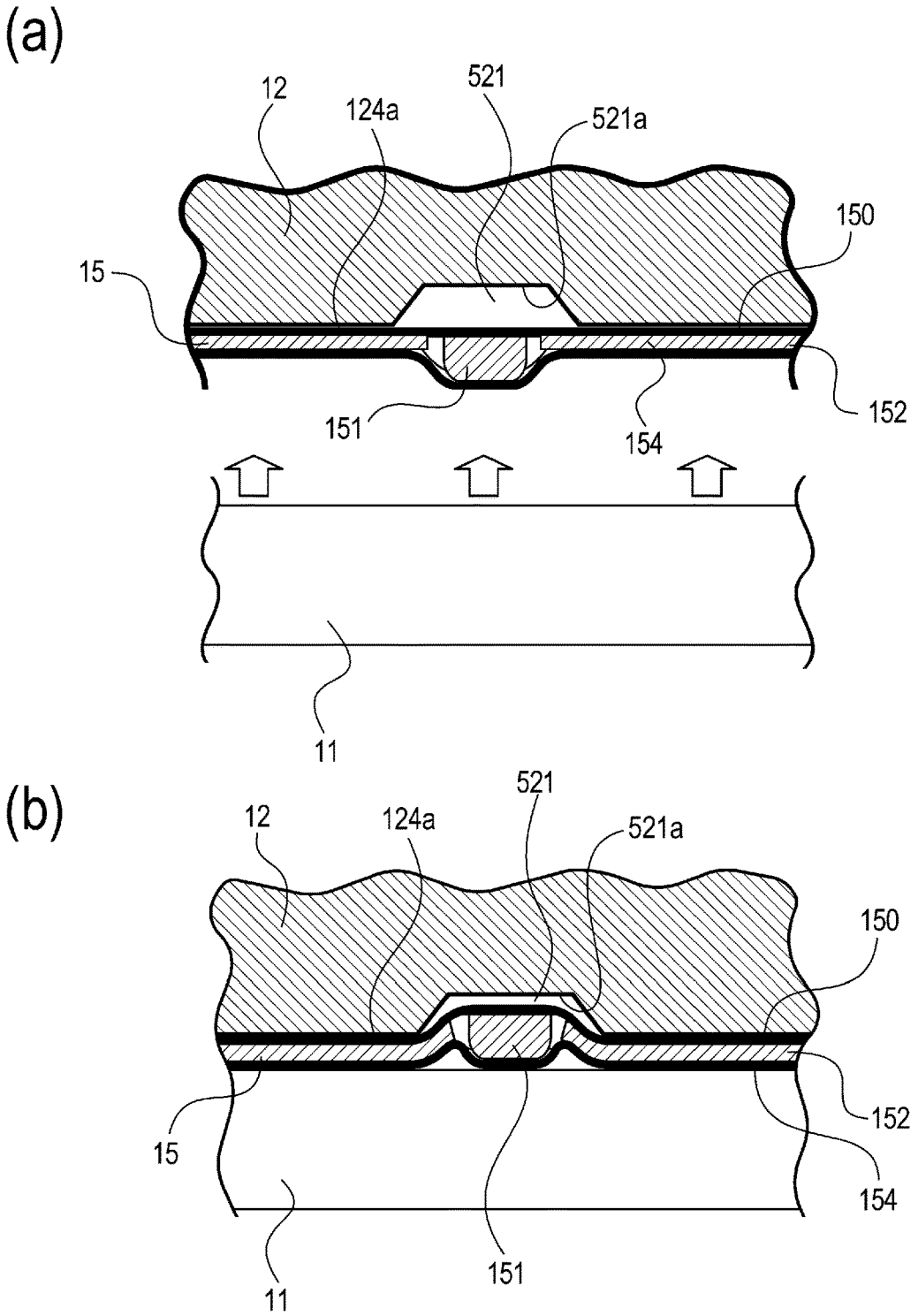
In FIG. 22, (a) is an exploded sectional view showing a structure of a neighborhood of a heat insulating holder, a temperature detecting member and a temperature-sensitive element for a heater in Ninth Embodiment, and (b) is a sectional illustration showing the structure of a neighborhood of the heat insulating holder, the temperature detecting member and the temperature-sensitive element for the heater in Ninth Embodiment.
Figure 23:
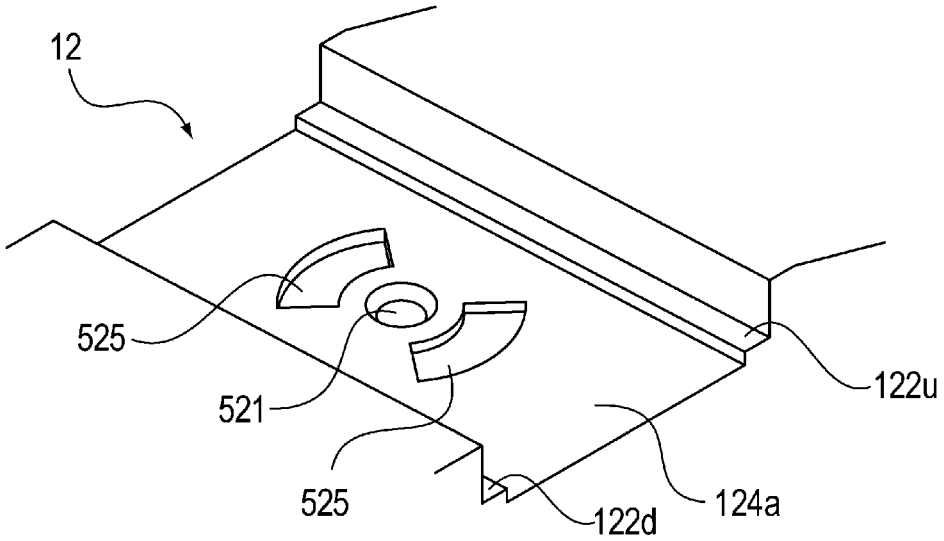
FIG. 23 is a perspective illustration showing a heat insulating holder in a modified embodiment in Ninth Embodiment as seen from a pressing roller side.

Next, structures of a temperature detecting member, in image heating apparatus and an image forming apparatus according to the present invention in Ninth Embodiment will be described using FIGS. 22 and 23. Incidentally, members or portions constituted similarly as those in the above-described embodiments will be omitted from description by adding the same reference numerals or symbols or the same member names even when the symbols are different. In FIG. 22, (a) is an exploded sectional view, in the neighborhood of the temperature-sensitive element, showing structures of the heat insulating holder, the temperature detecting member and the heater in this embodiment, and (b) is a sectional illustration, in the neighborhood of the temperature detecting member, showing the structures of the heat insulating holder, the temperature detecting member and the heater in this embodiment. FIG. 23 is a perspective illustration showing a modified embodiment of the heat insulating holder in this embodiment as seen from the pressing roller side.

In this embodiment, as shown in (a) and (b) of FIG. 22, a recessed portion 521 is provided at a position of the heat insulating holder 12 corresponding to a portion of the temperature-sensitive element 151 of the temperature detecting member 15. As regards the temperature detecting member 15 in this embodiment, a thickness of a portion of the temperature-sensitive element 151 with respect to the vertical direction shown in 8*a*) of FIG. 22 is larger than a thickness of a portion of the wiring electroconductor 152 at a periphery of the temperature-sensitive element 151.

For this reason, as shown in (a) of FIG. 22, the portion of the temperature-sensitive element 151 is thicker than the periphery thereof. Further, as regards the temperature detecting member 15 in this embodiment, as shown in (a) of FIG. 22, the temperature-sensitive element 151 and the wiring electroconductor 152 are provided on a planar base layer 150, and thereon, an insulating layer 154 is formed. For that reason, the temperature detecting member 15 before the temperature detecting member 15 is disposed in the fixing assembly 10 projects toward the insulating layer 153 side at the portion of the temperature-sensitive element 151.

The heat insulating holder 12 as the supports the temperature detecting member 15 in an opening side (lower side in (a) of FIG. 22) of the recessed portion 521 and supports the heater 11 (heating member, object) in a side opposite from the recessed portion 521 of the temperature detecting member 15.

When the temperature detecting member 15 is disposed on the heat insulating holder 12, as shown in (a) of FIG. 22, the base layer 150 side is contacted to the sensor disposing surface 124*a* of the heat insulating holder 12, and the projected portion of the temperature-sensitive element 151 faces the heater 11. In this embodiment, in place of the recessed portion 124*b* in Eighth Embodiment described above with reference to FIG. 10, the recessed portion 521 shown in (a) and (b) of FIG. 22 is provided.

As shown in (a) of FIG. 22, after the temperature detecting member 15 is disposed on the sensor disposing surface 124*a* of the heat insulating holder 12, the heater 11 is moved in an upward direction in (a) of FIG. 22 and is contacted to the portion of the temperature-sensitive element 151 projecting downward in (a) of FIG. 22, and thus urges the temperature-sensitive element 151 in the upward direction in (a) of FIG. 22. Then, the flexible temperature detecting member 15 is flexed, so that as shown in (b) of FIG. 22, the portion of the temperature-sensitive element 151 is embedded into the recessed portion 521.

As shown in (b) of FIG. 22, the temperature detecting member 15 is flexed at the portion, where the temperature-sensitive element 151 is provided, in a sandwiched state between the heat insulating holder (supporting member) and the heater 11 (heating member, object) and is embedded in the recessed portion 521.

When the portion of the temperature-sensitive element 151 is embedded in the recessed portion 151, although elongation and deformation of the base layer 150 generate, a restoring force acts on the base layer 150 in a direction of eliminating this distortion due to the elongation and deformation. By the restoring force of the temperature detecting member 15 itself, the portion of the temperature-sensitive element 151*c* is urged in the direction of the heater 11 (heating member, object). As a result, the portion of the temperature-sensitive element 151*c* is contacted to the heater 11 with reliability. For this reason, toner detection of the heater 11 can be stably performed by temperature-sensitive element 151. In this embodiment, the portion of the temperature-sensitive element 151 is urged in the direction of the heater 11 by the restoring portion of the base layer 150. For this reason, the pressing member 27 used in the above-described Eighth Embodiment shown in FIG. 10 can be omitted.

Further, a depth of the recessed portion 521 provided on the sensor disposing surface 124*a* of the heat insulating holder 12 with respect to the vertical direction in (a) of FIG. 12 is set so as to be larger than a height of the portion of the temperature-sensitive element 151 with respect to the vertical direction in (a) of FIG. 22. As a result, when the portion of the temperature-sensitive element 151 is embedded in the recessed portion 521, a gap is formed between the portion of the temperature-sensitive element 151 and the bottom 521*a* of the recessed portion 521 of the heat insulating holder 12. As a result, the portion of the temperature-sensitive element 151 contacts only the heater 11. For this reason, as shown in FIG. 10, compared with the above-described Eighth Embodiment in which the pressing member 27 contacted to the portion of the temperature-sensitive element 151, in this embodiment, unnecessary heat conduction is not needed, and correspondingly, temperature detection of the heater 11 by the temperature-sensitive element 151 can be performed further accurately.

Incidentally, when the temperature detecting member 15 is disposed on the sensor disposing surface 124*a* of the heat insulating holder 15, at a periphery of the portion of the temperature-sensitive element 151, the temperature detecting member 15 may also be bonded to the sensor disposing surface 124*a* of the heat insulating holder 12. At a position close to the temperature-sensitive element 151, by fixing the temperature detecting member 15 to the sensor disposing surface 124*a* of the heat insulating holder 12, a degree of positional deviation of the temperature detecting member 15 during use of the temperature detecting member 15 can be reduced, so that temperature detection accuracy of the heater 11 by the temperature-sensitive element 151 is enhanced.

In the modified embodiment of the sensor disposing surface 124*a* of the heat insulating holder 12, a groove 525 used for applying an adhesive onto a periphery of the recessed portion 521 provided in the sensor disposing surface 124*a* is provided. In the groove 525, a heat-resistant adhesive is applied. As shown in (b) of FIG. 22, the adhesive applied in the groove 525 is bonded to the portion of the temperature-sensitive element 151 when the portion of the temperature-sensitive element 151 is embedded in the recessed portion 521 by being urged upward in (b) of FIG. 22. As a result, the portion of the temperature-sensitive element 151 of the temperature detecting member 15 is adhesively fixed to the periphery of the recessed portion 521 of the heat insulating holder 12 (supporting member).

Further, fixing between the temperature detecting member 15 and the heat insulating holder 12 may also be carried out by, e.g., welding, sealing or the like when sufficient fixing force and positional accuracy are ensured by the fixing. Also in this embodiment, the realization of the downsizing and the thermal capacity reduction of the fixing device 10 in comparison with the above-described comparison example with reference to FIGS. 8 and 9 is similar to that in the above-described Eighth Embodiment. Other constitutions are similar to those in the above-described embodiments, so that a similar effect can be obtained.

<Tenth Embodiment>

Figure 24:
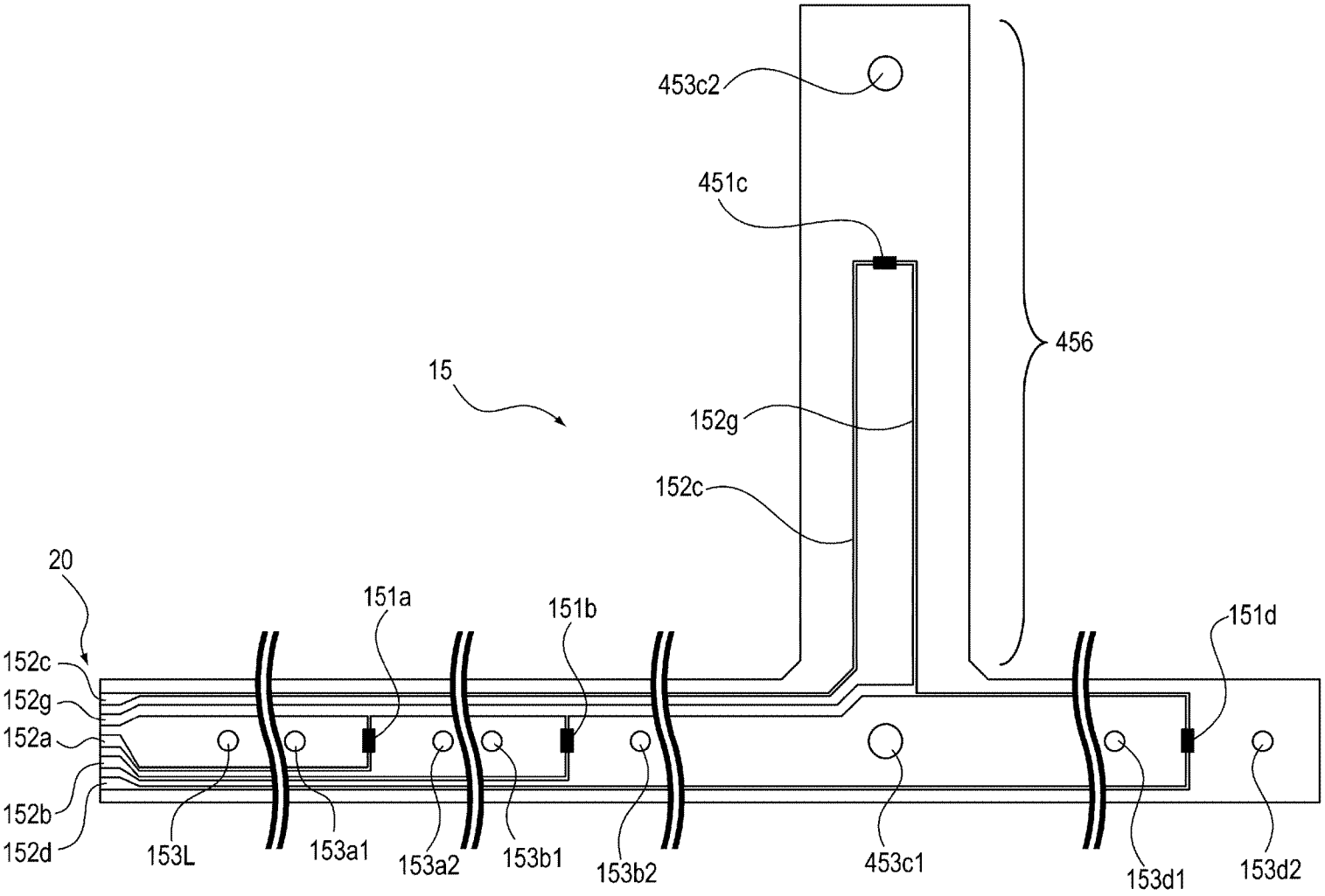
FIG. 24 is a bottom illustration of a temperature detecting member in Tenth Embodiment as seen from a pressing roller side.

Next, structures of a temperature detecting member, in image heating apparatus and an image forming apparatus according to the present invention in Tenth Embodiment will be described using FIG. 10. Incidentally, members or portions constituted similarly as those in the above-described respective embodiments will be omitted from description by adding the same reference numerals or symbols or the same member names even when the symbols are different. FIG. 24 is a bottom illustration of the temperature detecting member 15 in this embodiment as seen from the recessed portion 16 side.

In this embodiment, in place of the temperature-sensitive element 151*c* provided at the place corresponding to the C-C position of the temperature detecting member 15 in the above-described Fifth Embodiment shown in FIG. 15, a temperature-sensitive element 451*c* shown in FIG. 24 is provided. The temperature-sensitive element 451*c* detects the temperature of the inner peripheral surface of the fixing film 13 (endless belt, object) similarly as in the above-described Fourth Embodiment shown in FIG. 12. Similarly as the temperature detecting member 15 in the above-described Fourth Embodiment shown in FIG. 13, also the temperature detecting member 15 in this embodiment shown in FIG. 24 is constituted in a T-shape such that a branch portion 456 where the temperature-sensitive element 451*c* is provided is formed.

A mounting structure of the branch portion 456 of the T-shaped temperature detecting member 15 is similar to that in the above-described Fourth Embodiment shown in FIG. 8, and therefore, redundant description will be omitted.

Also in this embodiment, by the temperature-sensitive element 451*c* provided at the branch portion 456 of the temperature detecting member 15, it is possible to detect the temperature of the inner peripheral surface of the fixing film 13 which is a member directly conducting the heat to the recording material P by the temperature-sensitive element 451*e*. As a result, in this embodiment, the temperature of the fixing device 6 as the image heating apparatus can be controlled to a proper toner image heating temperature with high accuracy compared with the above-described Fifth to Ninth Embodiments.

Further, the realization of the downsizing and the thermal capacity reduction of the fixing device 10 in comparison with the above-described comparison example with reference to FIGS. 8 and 9 is similar to that in the above-described Fifth Embodiment. Other constitutions are similar to those in the above-described embodiments, so that a similar effect can be obtained.

[Other Embodiments]

In the above-described embodiments, the example of the fixing device 6 consisting of the image heating apparatus of the film fixing type was described, but the present invention may also be applied to image heating apparatuses of other types. For example, the downsizing and the thermal capacity reduction can be realized using an image heating apparatus of an electromagnetic induction heating type.

Further, in the above-described embodiments, the example of the image heating apparatus in which the temperature detecting member 15 was provided with the four temperature-sensitive elements was described, but the number of the temperature-sensitive elements provided in the temperature detecting member 15 is not required to be limited to four. As regards the number of the temperature-sensitive elements, the downsizing and the thermal capacity reduction can be realized even by also not less than a single temperature-sensitive element. Further, in the above-described embodiments, the constitution in which the single temperature detecting member 15 was provided with the four temperature-sensitive elements was employed, but even when a plurality of temperature-sensitive elements are provided separately to a plurality of temperature detecting members, the downsizing and the thermal capacity reduction can be realized.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-086815 filed on Apr. 25, 2016, which is hereby incorporated by reference herein in its entirety.

What is claimed is:

1. A temperature detecting member for detecting a temperature of an object of a fixing device in contact with the object, said temperature detecting member comprising:

a first film having an insulating property;

a temperature-sensitive element provided on said first film;

an electroconductive pattern formed on said first film, said electroconductive pattern being electrically connected with said temperature-sensitive element, and a second film configured to cover said temperature-sensitive element and said electroconductive pattern in cooperation with said first film.

2. A temperature detecting member according to claim 1, wherein said first film has an elongated shape, and said temperature-sensitive element includes a plurality of temperature-sensitive element portions which are provided on said first film with intervals with respect to a longitudinal direction of said first film.

3. A temperature detecting member according to claim 1, wherein said temperature-sensitive element is a thermistor resistance element.

4. A temperature detecting member according to claim 2, further comprising contacts provided at end portions with respect to the longitudinal direction of said first film.

5. A fixing device for fixing an image on a recording material, comprising:

a cylindrical belt contacting the image;

a heating member configured to heat said belt, said heating member contacting said belt; and a temperature detecting member configured to detect a temperature of said heating member, said temperature detecting member including a first film having an insulating property, a temperature-sensitive element provided on said first film, an electroconductive pattern formed on said first film and being electrically connected with said temperature-sensitive element, and a second film configured to cover said temperature-sensitive element and said electroconductive pattern in cooperation with said first film, wherein said temperature detecting member is constituted so that at least a portion of said first film corresponding to said temperature-sensitive element contacts said heating member.

6. A fixing device according to claim 5, further comprising a pressing member configured to press the portion of said first film corresponding to said temperature-sensitive element toward said heating member.

7. A fixing device according to claim 6, further comprising a supporting member configured to support a surface of said heating member in a side opposite from a belt contacting surface of said heating member, said supporting member being provided with an opening, wherein said temperature detecting member is provided between said supporting member and said heating member, and wherein said pressing member is provided at said opening.

8. A fixing device according to claim 6, further comprising a supporting member configured to support a surface of said heating member in a side opposite from a belt contacting surface of said heating member, said supporting member being provided with a recessed portion at a surface opposing said heating member, wherein said pressing member is provided at the recessed portion of said supporting member.

9. A fixing device according to claim 5, wherein said first film has an elongated shape, and said temperature-sensitive element includes a plurality of temperature-sensitive element portions which are provided on said first film with intervals with respect to a longitudinal direction of said first film.

10. A fixing device according to claim 5, wherein said temperature-sensitive element is a thermistor resistance element.

11. A fixing device according to claim 9, wherein said temperature detecting member includes contacts provided at end portions with respect to the longitudinal direction of said first film.

12. A temperature detecting member according to claim 1, wherein said first film has an elongated shape, and said temperature-sensitive element includes a first and second temperature-sensitive element portions which are provided on said first film with an interval with respect to a longitudinal direction of said first film, and wherein said electroconductive pattern includes a first electroconductor which is electrically connected with said first temperature-sensitive element, a second electroconductor which is electrically connected with said second temperature-sensitive element, and a common electroconductor which is electrically connected with said first and second temperature-sensitive elements.

13. A fixing device according to claim 5, wherein said first film has an elongated shape, and said temperature-sensitive element includes a first and second temperature-sensitive element portions which are provided on said first film with intervals with respect to a longitudinal direction of said first film, and wherein said electroconductive pattern includes a first electroconductor which is electrically connected with said first temperature-sensitive element, a second electroconductor which is electrically connected with said second temperature-sensitive element, and a common electroconductor which is electrically connected with said first and second temperature-sensitive elements.

14. A temperature detecting member for detecting a temperature of an object of a fixing device in contact with the object, said temperature detecting member comprising:

a film having an insulating property;

first and second temperature-sensitive elements which are provided on said film with an interval with respect to a longitudinal direction of said film, and each of which includes a thermistor element;

a first electroconductor which is electrically connected with said first temperature-sensitive element;

a second electroconductor which is electrically connected with said second temperature-sensitive element; and a common electroconductor which is electrically connected with said first and second temperature-sensitive elements.

15. A fixing device for fixing an image on a recording material, comprising:

a cylindrical belt contacting the image;

a heating member configured to heat said belt, said heating member contacting said belt; and a temperature detecting member configured to detect a temperature of said heating member, said temperature detecting member including a film having an insulating property, first and second temperature-sensitive elements which are provided on said film with intervals with respect to a longitudinal direction of said film, and each of which includes a thermistor element, a first electroconductor which is electrically connected with said first temperature-sensitive element, a second electroconductor which is electrically connected with said second temperature-sensitive element, and a common electroconductor which is electrically connected with said first and second temperature-sensitive elements, wherein said temperature detecting member is constituted so that at least portions of said film corresponding to said first and second temperature-sensitive elements contact said heating member.

* * * * *